US007305799B2

(12) United States Patent
Smelser et al.

(10) Patent No.: US 7,305,799 B2
(45) Date of Patent: Dec. 11, 2007

(54) BEARING BRACE APPARATUS

(75) Inventors: James M. Smelser, Sandy, UT (US); Andrew J. Hinchman, Salt Lake City, UT (US)

(73) Assignee: SME Steel Contractors, Inc., West Jordan, UT (US)

( * ) Notice: Subject to any disclaimer, the term of this patent is extended or adjusted under 35 U.S.C. 154(b) by 384 days.

(21) Appl. No.: 10/405,424

(22) Filed: Apr. 1, 2003

(65) Prior Publication Data

US 2003/0222188 A1 Dec. 4, 2003

Related U.S. Application Data

(63) Continuation-in-part of application No. 10/158,738, filed on May 29, 2002, now Pat. No. 7,174,680.

(51) Int. Cl.
*E04H 9/02* (2006.01)

(52) U.S. Cl. ..... 52/167.3; 52/167.1; 52/167.8; 52/740.6; 52/731.7; 52/737.4; 52/736.3

(58) Field of Classification Search ..... 52/740.1, 52/740.6, 740.2, 426, 99, 100, 733.3, 737.4, 52/731.7, 731.8, 724.1, 731.2, 167.9, 167.7, 52/167.1, 167.3, 167.8, 723.1, 724.5, 736.3, 52/738.1, 98, 730.6

See application file for complete search history.

(56) References Cited

U.S. PATENT DOCUMENTS 312,349 A * 2/1885 Griffin ..... 52/721.4
735,759 A * 8/1903 Guest ..... 52/740.2
858,410 A * 7/1907 Mueller ..... 52/740.2
1,804,320 A * 5/1931 Cross ..... 52/249

(Continued)

FOREIGN PATENT DOCUMENTS

IN 155036 7/1982

(Continued)

OTHER PUBLICATIONS

Nippon Steel Corp., Steel Structure Div., Toykyo Japan, "Unbonded Brace" (Applicant makes no claim that this is prior art and have no idea when the brochure was published).

(Continued)

*Primary Examiner*—Lanna Mai
*Assistant Examiner*—Phi Dieu Tran A
(74) *Attorney, Agent, or Firm*—Metcalf Intellectual Property Law, LLC

(57) ABSTRACT

A brace apparatus having a core member adapted to absorb energy by undergoing plastic deformation and a buckling restraining assembly that maintains the structural integrity of the brace apparatus once the core member has undergone plastic deformation. A core member having a variable width middle portion is provided to control deformation of the core member such that the middle portion center undergoes plastic deformation before the middle portion first and second ends. A core member is provided which includes a core stiffener permitting the brace apparatus to have a longer longer length relative to the core member cross-sectional area while providing both a desired yield point and the stiffness needed rigidity required for structural support. One or more projections are provided having a stress reduction voids which reduce the cross sectional area of the core member to eliminate stress risers that would otherwise be present at the portion of the core member corresponding with the projections.

16 Claims, 12 Drawing Sheets

U.S. PATENT DOCUMENTS

| | | | | | |
|---|---|---|---|---|---|
| 2,198,985 | A | * | 4/1940 | Bailey | 405/253 |
| 2,652,713 | A | * | 9/1953 | Senglar | 52/583.1 |
| 3,214,875 | A | * | 11/1965 | Slowinski et al. | 52/364 |
| 3,232,638 | A | | 2/1966 | Hollander | 285/55 |
| 3,355,852 | A | * | 12/1967 | Lally | 52/721.4 |
| 3,430,406 | A | * | 3/1969 | Weber | 52/660 |
| 3,748,795 | A | * | 7/1973 | Berntsen | 52/98 |
| 3,835,608 | A | * | 9/1974 | Johnson | 52/426 |
| 3,867,804 | A | * | 2/1975 | Wilson | 52/699 |
| 3,916,592 | A | * | 11/1975 | Morohashi et al. | 52/252 |
| 4,417,427 | A | * | 11/1983 | Bschorr | 52/167.1 |
| 4,571,913 | A | * | 2/1986 | Schleich et al. | 52/724.1 |
| 4,605,106 | A | * | 8/1986 | Fyfe et al. | 188/374 |
| 4,630,412 | A | * | 12/1986 | Engstrom et al. | 52/1 |
| 4,641,468 | A | * | 2/1987 | Slater | 52/309.4 |
| 5,038,541 | A | * | 8/1991 | Gibbar, Jr. | 52/295 |
| 5,065,555 | A | * | 11/1991 | Kobori et al. | 52/167.7 |
| 5,163,256 | A | * | 11/1992 | Fukumoto et al. | 52/167.1 |
| 5,175,972 | A | | 1/1993 | Sridhara | 52/727 |
| 5,471,810 | A | * | 12/1995 | Sugisawa et al. | 52/731.7 |
| 5,768,851 | A | * | 6/1998 | Nagaoka | 52/790.1 |
| 6,219,988 | B1 | * | 4/2001 | Mahfouz et al. | 52/721.4 |
| 6,668,502 | B2 | * | 12/2003 | Beliveau | 52/426 |
| 2001/0000840 | A1 | | 5/2001 | Takeuchi et al. | |
| 2003/0205008 | A1 | | 11/2003 | Sridhara | |

FOREIGN PATENT DOCUMENTS

| | | | | |
|---|---|---|---|---|
| JP | 1-187271 | | 7/1989 | |
| JP | 1-268933 | * | 10/1989 | 52/167.3 |
| JP | 2-88833 | * | 3/1990 | 52/167.3 |
| JP | 3-199542 | | 8/1991 | |
| JP | 3-199581 | | 8/1991 | |
| JP | 3-199582 | | 8/1991 | |
| JP | 3-228975 | * | 10/1991 | 52/167.3 |
| JP | 3-262881 | | 11/1991 | |
| JP | 4-70438 | | 3/1992 | |
| JP | 4-19121 | | 4/1992 | |
| JP | 5-9977 | | 1/1993 | |
| JP | 5-71242 | | 3/1993 | |
| JP | 5-133137 | | 5/1993 | |
| JP | 5-57110 | | 7/1993 | |
| JP | 5-57111 | | 7/1993 | |
| JP | 7-229204 | | 8/1995 | |
| JP | 7-324377 | | 12/1995 | |
| JP | 7-324378 | | 12/1995 | |
| JP | 9-221830 | | 8/1997 | |
| JP | 9-328813 | | 12/1997 | |
| JP | 10-110470 | | 4/1998 | |
| JP | 10-306498 | | 11/1998 | |
| JP | 11-29978 | | 2/1999 | |
| JP | 11-29987 | | 2/1999 | |
| JP | 11-117404 | | 4/1999 | |
| JP | 11-153194 | | 6/1999 | |
| JP | 11-159010 | | 6/1999 | |
| JP | 11-172783 | | 6/1999 | |
| JP | 11-172784 | | 6/1999 | |
| JP | 11-280294 | | 10/1999 | |
| JP | 2000-27292 | | 1/2000 | |
| JP | 2000-27293 | | 1/2000 | |
| JP | 2000-45562 | | 2/2000 | |
| JP | 2000-96867 | | 4/2000 | |
| JP | 2000-110257 | | 4/2000 | |
| JP | 2000-144900 | | 5/2000 | |
| JP | 2000-186372 | | 7/2000 | |
| JP | 2000-265602 | | 9/2000 | |
| JP | 2000-265706 | | 9/2000 | |
| JP | 2002-167863 | * | 6/2002 | 52/167.3 |
| JP | 5-3402 | | 1/2003 | |
| WO | WO-02/22994 A1 | | 3/2002 | |

OTHER PUBLICATIONS

"Fully Braced for Seismic Survival," Engineering, Jul. 19, 1997, pp. 34-36.

Nippon Steel Corp., Building Construction and Urban Development Divs., Engineering Business Organization (to the best of Applicant's knowledge and belief, this reference was published at least as early as 1998).

Tube Investment of India LTD, A Report on the New Concept of Sleeved Column and its Applications, Aug. 28, 2001 (While applicant is not aware if or when this reference may have been published, to the best of the applicant's knowledge and belief, this reference was published prior to the date of the above referenced patent.).

Eric Ko, Andrew Mole, Ian Aiken, Frederick Tajirian, Zigmund Rubel and Isao Kimura, Application of the Unbonded Brace in Medical Facilities, Jul. 2002 (While applicant is not aware if or when this reference may have been published, to the best of the applicant's knowledge and belief, this reference was published prior to the date of the above referenced patent.).

Parry Brow, S.E., Ian D. Aiken, Ph.D., P.E., F. Jeff Jafarzadeh, P.E., Seismic Retrofit of the Wallace F. Bennett Federal Building, Aug. 2001.

Ian D. Aiken and Isao Kimura, The Use of Buckling-Restrained Braces in the United States (While applicant is not aware if or when this reference may have been published, to the best of the applicant's knowledge and belief, this reference was published prior to the date of the above referenced patent.).

David B. Rosenbaum, 'New' Seismic-Resistant System Finally Gets Warm U.S. Welcome, Jun. 3, 2002.

Gil Davis, Catch the next Wave, Apr. 2002.

Rafael Sabelli, Stephen Mahin and Chunho Chang, Seismic Demands on Steel Braced Frame Buildings with Buckling-Restrained Braces (While applicant is not aware if or when this reference may have been published, to the best of the applicant's knowledge and belief, this reference was published prior to the date of the above referenced patent.).

Atsushi Watanabe, Yasuyoshi Hitomi, Eilchiro Saeki, Akira Wada, and Morihisa Pujimoto, Properties of Brace Encased in Buckling-Restraining Concrete and Steel Tube, Aug. 1988 (While applicant is not aware of the exact date of publication, to the best of applicant's knowledge and belief this reference was published prior to the filing date of the above referenced application).

Peter Clark, Ian Aiken, Kazuhiko Kasai, Eric Ko, and Isao Kimura, Design Procedures for Buildings Incorporating Hysteretic Damping Devices, Oct. 1999 (While applicant is not aware of the exact date of publication, to the best of applicant's knowledge and belief this reference was published prior to the filing date of the above referenced application).

* cited by examiner

BEARING BRACE APPARATUS

CROSS-REFERENCE TO RELATED APPLICATIONS

This is a continuation-in-part application of U.S. patent application Ser. No. 10/158,738 entitled Bearing Brace Apparatus filed May 29, 2002 now U.S. Pat. No. 7,174,680.

BACKGROUND OF THE INVENTION

1. The Field of the Invention

The present invention relates to structural braces. More particularly, the present invention relates to a brace apparatus having a core member and a buckling restraining assembly. The buckling restraining assembly includes one or more bearings located proximal the core member. The bearings are adapted to minimize friction between the core member and the buckling restraining apparatus. An air gap is positioned between the core member and the one or more bearings of the buckling restraining apparatus to prevent bonding of the core member and buckling restraining assembly.

2. The Relevant Technology

For decades steel frame, structures have been a mainstay in the construction of everything from low-rise apartment buildings to enormous skyscrapers dominating modern city sky lines. The strength and versatility of steel is one reason for the lasting popularity of steel as a building material. In recent years, steel frame structures have been the focus of new innovation. Much of this innovation is directed to minimize the effects of earthquakes on steel frame structures. Earthquakes provide a unique challenge to building construction due to the magnitude of the forces that can be exerted on the frame of the building. A variety of building techniques have been utilized to minimize the impact of seismic forces exerted on buildings during an earthquake.

One mechanism that has been developed to minimize the impact of seismic forces is a structural brace that is adapted to absorb seismic energy through plastic deformation. While the brace is adapted to absorb energy by plastic deformation, it is also configured to resist buckling. While several embodiments of these energy absorbing braces exist, one popular design incorporates a steel core and a concrete filled bracing element. The steel core includes a yielding portion adapted to undergo plastic deformation when subjected to seismic magnitude forces. Compressive and/or tensile forces experienced during an earthquake are absorbed by compression or elongation of the steel core. While the strength of the steel core will drop as a result of buckling, the concrete filled bracing element provides the required rigidity to limit this buckling to allow the structural brace to provide structural support. In short, the steel core is adapted to dissipate seismic energy while the concrete filled bracing element is adapted to maintain the integrity of the structural brace when the steel core is deformed. The use of energy absorbing braces allows a building to absorb the seismic energy experienced during an earthquake. This permits buildings to be designed and manufactured with lighter, less massive, and less expensive structural members while maintaining the building's ability to withstand forces produced during an earthquake.

One difficulty in the design of energy absorbing braces is that the steel core should be allowed to move independently of the bracing element. To allow the steel core to move independently of the bracing element, the steel core is prevented from bonding with the bracing element during manufacture of the energy absorbing brace. By preventing the steel core from bonding to the bracing element, the steel core can absorb seismic energy imparted by the ends of the structural brace without conveying the energy to the bracing element. For example, during an earthquake the steel core is displaced relative to the bracing element as the steel core undergoes compression and elongation.

One design that has been developed to prevent bonding of the steel core and the bracing element utilizes an asphaltic rubber layer positioned between the steel core and the bracing element. The asphaltic rubber layer is bonded to both the steel core and the bracing element. However, using an asphaltic rubber layer to prevent bonding of the steel core and the bracing element results in difficulties as well. When seismic forces are exerted on the brace, compression and elongation of the steel core shears the asphaltic rubber layer. Deformation of the steel core and shearing of the substantially non-compressible asphaltic rubber layer results in enormous pressure being exerted on the asphaltic rubber layer. Additionally, the asphaltic rubber layer deteriorates after a limited number of compression and elongation cycles.

Yet another difficulty encountered relates to manufacturing of the brace. Where the bracing element utilized in the energy absorbing brace comprises a concrete filled tube, manufacturing the brace is complex. Concrete filled bracing elements are typically manufactured by positioning the tube vertically, placing a steel core covered with asphaltic rubber inside the tube, and pouring concrete into the tube. This method of manufacturing concrete filled braces results in compression of the asphaltic rubber at one end of the element more than the other end of the element. Because the thickness of the asphaltic rubber layer can play an important role in the performance of the energy absorbing brace, complex manufacturing processes must be employed to maintain adequate consistency in the thickness of the asphaltic rubber layer.

BRIEF SUMMARY OF THE INVENTION

The present invention relates to brace apparatuses. More particularly, the present invention relates to a brace apparatus having a core member and a buckling restraining assembly. The core member is adapted to absorb energy by undergoing plastic deformation. The buckling restraining assembly maintains the structural integrity of the brace apparatus once the core member has undergone plastic deformation. The buckling restraining assembly includes one or more bearings located proximal the core member. The bearing members are adapted to minimize friction between the core member and the buckling restraining apparatus. An air gap is positioned between the core member and the one or more bearings of the buckling restraining apparatus to prevent bonding of the core member and the buckling restraining assembly. The use of an air gap minimizes the pressure exerted on the buckling restraining assembly during plastic deformation of the buckling restraining apparatus, allowing the core member to expand when the core member undergoes plastic deformation during a compression cycle.

According to one aspect of the present invention, a core member middle portion having a variable width is provided to control deformation of the core member such that the middle portion center undergoes plastic deformation before the middle portion first and second ends. According to another aspect of the present invention, the core member includes a core stiffener which permits the brace apparatus to have a longer length relative to the core member cross-sectional area while providing both a desired yield point and the stiffness required for structural support.

According to one aspect of the present invention, one or more projections are included in the core member of the brace apparatus. The projections are adapted to be coupled to the cementious layer. In one embodiment the projections are contiguous with the middle portion of the core member and are configured to minimize movement of the middle portion of the core member relative to the portion of the buckling restraining assembly corresponding to the middle portion of the core member. In another embodiment, each projection include a stress reduction void to reduce the probability of premature failure of the core member. The stress reduction void can maintain a consistent cross sectional area of the core member to eliminate stress risers that would otherwise be present at the portion of the core member corresponding with the projections.

According to another aspect of the present invention, lateral supports are coupled to the core member of the brace apparatus. One or more reinforcement assemblies are provided that correspond with a portion of the lateral supports and the bearing members. The reinforcement assemblies provide additional support to the portions of the brace apparatus corresponding with the lateral supports. In one embodiment, the reinforcement assemblies are positioned between the cementious layer and the bearing members.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention relates to brace apparatuses. More particularly, the present invention relates to a brace apparatus having a core member and a buckling restraining assembly, the buckling restraining assembly having one or more bearings located proximal the core member being adapted to minimize friction between the core member and the buckling restraining apparatus. An air gap is positioned between the core member and the one or more bearings of the buckling restraining apparatus to prevent bonding between the core member and the buckling restraining assembly.

According to one aspect of the present invention, a core member middle portion having a variable width is provided to control deformation of the core member such that the middle portion center undergoes plastic deformation before the middle portion first and second ends. According to another aspect of the present invention, the core member includes a core stiffener which permits the brace apparatus to have a longer length relative to the core member cross-sectional area while providing both a desired yield point and the stiffness required for structural support.

According to one aspect of the present invention, one or more projections are included in the core member of the brace apparatus. The projections are adapted to be coupled to the cementious layer. In one embodiment the projections are contiguous with the middle portion of the core member and are configured to minimize movement of the middle portion of the core member relative to the portion of the buckling restraining assembly corresponding to the middle portion of the core member. In another embodiment, each projection includes a stress reduction void to reduce the probability of premature failure of the core member. The stress reduction void can maintain a consistent cross sectional area of the core member to eliminate stress risers that would otherwise be present at the portion of the core member corresponding with the projections.

According to another aspect of the present invention, lateral supports are coupled to the core member of the brace apparatus. One or more reinforcement assemblies are provided that correspond with a portion of the lateral supports and the bearing members. The reinforcement assemblies provide additional support to the portions of the brace apparatus corresponding with the lateral supports. In one embodiment, the reinforcement assemblies are positioned between the cementious layer and the bearing members.

Figure 1:
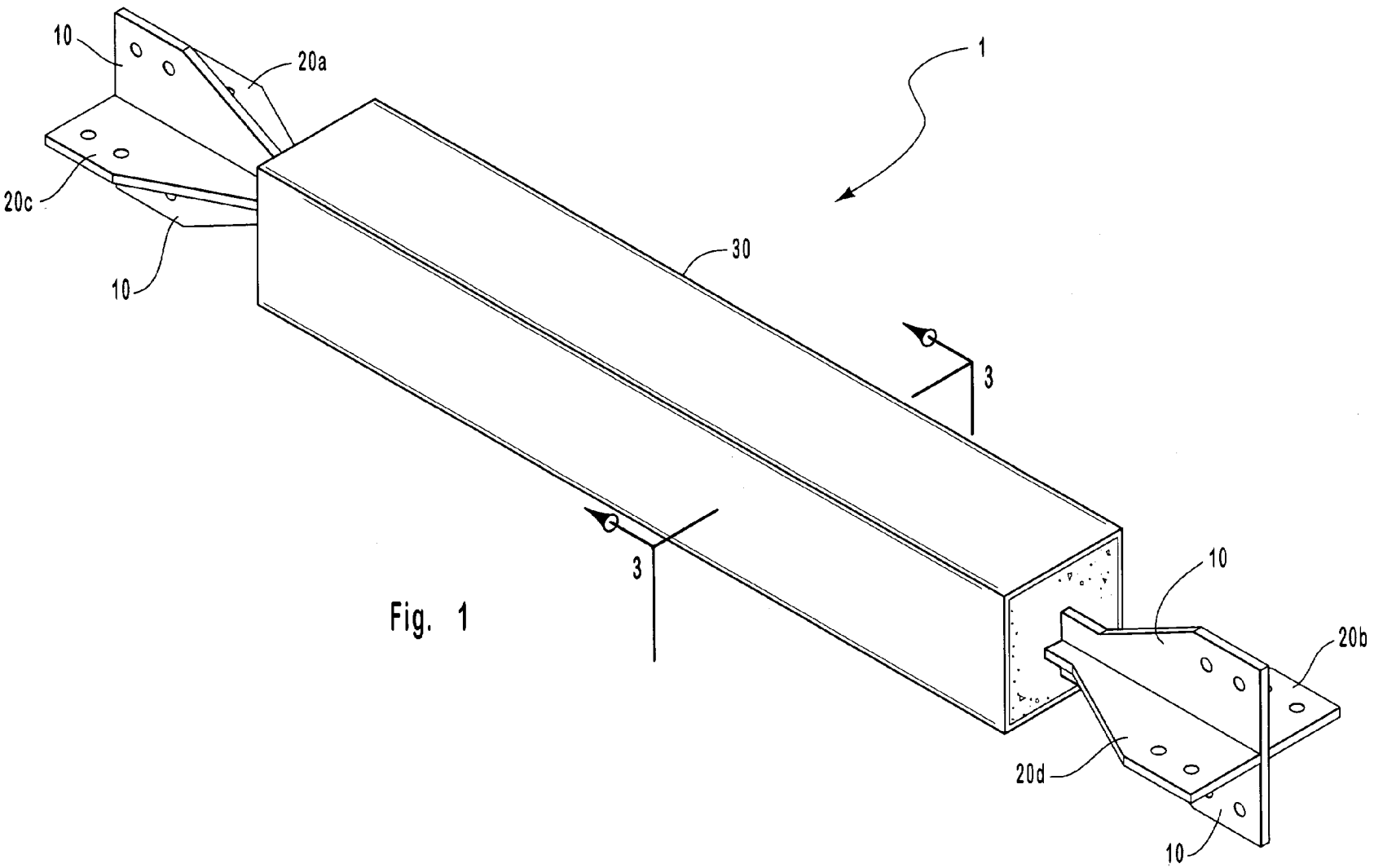
FIG. 1 is a perspective view illustrating one embodiment of the brace apparatus of the present invention.

FIG. 1 is a perspective view illustrating one embodiment of a brace apparatus 1 of the present invention. Brace apparatus 1 comprises a core member 10, lateral supports 20*a, b* and a buckling restraining assembly 30. Core member 10 is adapted to absorb seismic or other forces exerted on brace apparatus 1. Depending on the characteristics of core member 10, such as size, width, length, construction, modulus of elasticity, etc., such forces will either be absorbed by the elastic qualities of the core or by plastic deformation of the core member. In the preferred embodiment, core member 10 is comprised of steel. In an alternative embodiment of the present invention, core member 10 is comprised of a non-steel metal.

Lateral supports 20*a, b, c, d* are attached to core member 10. Lateral supports 20*a, b* provide additional support to core member 10. In one embodiment, lateral supports 20*a, b* are adapted to provide additional support primarily to the ends of core member 10. In an alternative embodiment, lateral supports 20*a, b, c, d* are adapted to provide additional support to most or all of the entire length of core member 10.

Buckling restraining assembly 30 is adapted to surround, and provide additional support, to the middle portion of core member 10. The additional support provided by buckling restraining assembly 30 allows core member 10 to absorb large amounts of force by plastic deformation while maintaining the structural integrity of the brace apparatus 1. Because plastic deformation of a core member 10 can result in buckling and substantial weakening of core member 10, the additional support provided by buckling restraining assembly 30 provides the support needed to maintain the structural integrity of brace apparatus 1 under the magnitude of forces experienced during an earthquake, or event of similar magnitude. A variety of types and configurations of buckling restraining assembly 30 are possible without departing from the scope and spirit of the present invention. Illustrative embodiments of buckling restraining assembly 30 will be discussed with reference to FIGS. 3-7.

Figure 2A:
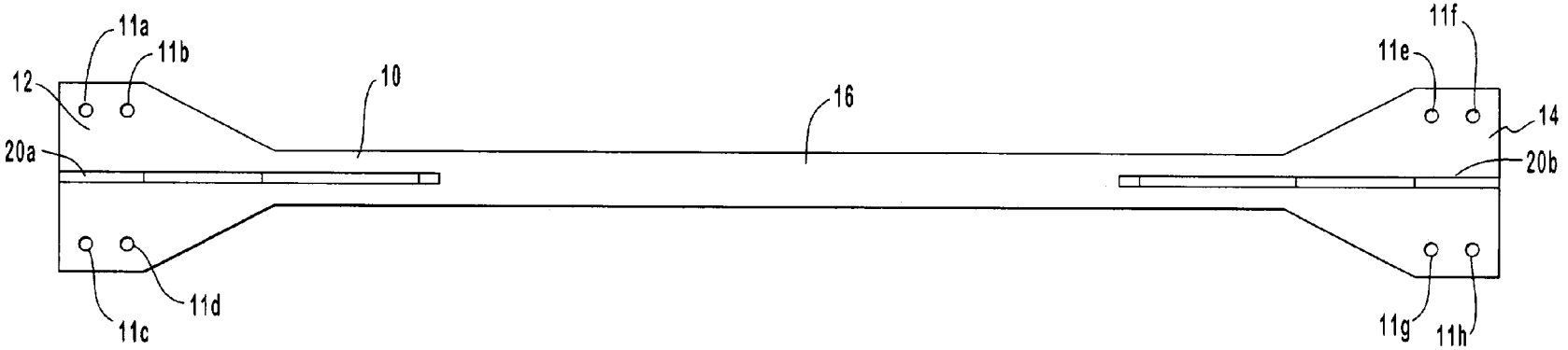
FIG. 2A is a side view illustrating one embodiment of the core member of the present invention.

FIG. 2A is a side view illustrating one embodiment of core member 10 of the present invention. In the illustrated embodiment, core member 10 comprises a metal core support of uniform construction. Core member 10 comprises a core member first end 12, a core member second end 14, and a core member middle portion 16. Core member first end 12 is configured to be wider than core member middle portion 16, thus providing additional rigidity to core member first end 12 in the vertical direction. Core member first end 12 includes holes 11*a-d*. Holes 11*a-d* are adapted to provide a mechanism for coupling the brace apparatus 1 to other structural members.

Core member second end 14 is also wider than the core member middle portion 16, thus providing additional rigidity to core member second end 14 in the vertical direction. Core member second end 14 also includes holes 11*e-h*. Holes 11*e-h* are adapted to provide a mechanism for coupling brace apparatus 1 to other structural members of the frame structure. Core member middle portion 16 is narrower than core member first end 12 and core member second end 14. As previously mentioned, core member 10 is adapted to absorb seismic or other forces exerted on the brace apparatus. Core member middle portion 16 is adapted to yield under earthquake magnitude loads. The narrow configuration of core member middle portion 16 renders core member middle portion 16 more susceptible to buckling under extreme forces. This permits core member middle portion 16 to absorb much of the seismic or other energy through plastic deformation while maintaining the integrity of core member first and second ends 12, 14. The amount of energy that can be absorbed by the core member middle portion 16, and the amount of energy required to result in plastic deformation of the core member middle portion 16, will vary based on the attributes of the middle portion such as size, width, length, construction, modulus of elasticity, etc. As will be appreciated by those skilled in the art, the core member is not limited to the embodiment of FIG. 2A, but can be of a variety of types and configurations.

Figure 2B:
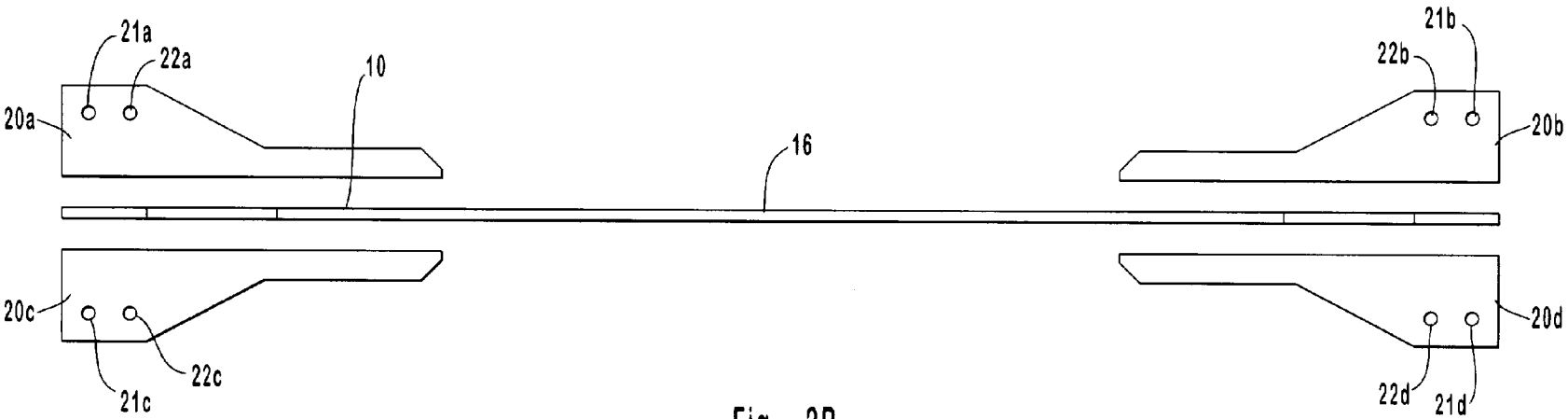
FIG. 2B is a top schematic view illustrating lateral members separated from the core member according to one embodiment of the present invention.

FIG. 2B is a top view illustrating lateral supports 20*a-d* separated from core member 10 according to one embodiment of the present invention. Lateral supports 20*a-d* are adapted to provide additional support to the core member. In the illustrated embodiment, lateral supports comprise a plurality of lateral supports including, first lateral support 20*a*, second lateral support 20*b*, third lateral support 20*c*, and fourth a lateral support 20*d*.

Lateral supports 20*a-d* provide additional support to the core member first end 12 and the core member second end 14. By providing additional support, the portions of the core member 10 corresponding with the lateral supports 20*a-d* are less likely to buckle. By rendering some portions of the core member 10 less likely to buckle, portions of the core member 10 not corresponding with the lateral supports 20*a-d* are more likely to undergo plastic deformation when a seismic magnitude force is exerted on brace apparatus 1. Because, the position of lateral supports 20*a-d* strengthens core member first and second ends 12, 14, core member middle portion 16 is more likely to buckle when intense pressure is exerted on the brace apparatus 1.

The buckling of core member middle portion 16, while weakening core member 10, does not prevent brace apparatus 1 from carrying a load because core member middle portion 16 is supported by buckling restraining assembly 30. Core member first and second ends 12, 14, while not benefiting from the support of the buckling restraining assembly 30, nevertheless are prevented from buckling by lateral supports 20*a-d*. As will be appreciated by those skilled in the art, the ability of the brace apparatus 1 to withstand a force is based on the characteristics of the brace and the magnitude of the force. Where the force exerted on brace apparatus 1 is above the amount needed to deform core member 10 and below the amount capable of resulting in the failure of brace apparatus 1, the core member will undergo plastic deformation without resulting in the failure of brace apparatus 1.

In the illustrated embodiment, lateral supports 20*a-d* are adapted to provide an attachment mechanism for coupling brace apparatus 1 to other structural members. A plurality of holes 21*a, b, c, d* and 22*a, b, c, d* are provided to attach brace apparatus 1 to other structural members of the frame structure. The first lateral support 20*a* includes holes 21*a*, 22*a*. The second lateral support 20*b* includes holes 21*b*, 22*b*. The third lateral support 20*c* includes holes 21*c*, 22*c*. The fourth lateral support 20*d* includes holes 21*d*, 22*d*. As will be appreciated by those skilled in the art, a variety of attachment mechanisms can be utilized within the scope and spirit of the present invention.

Figure 3:
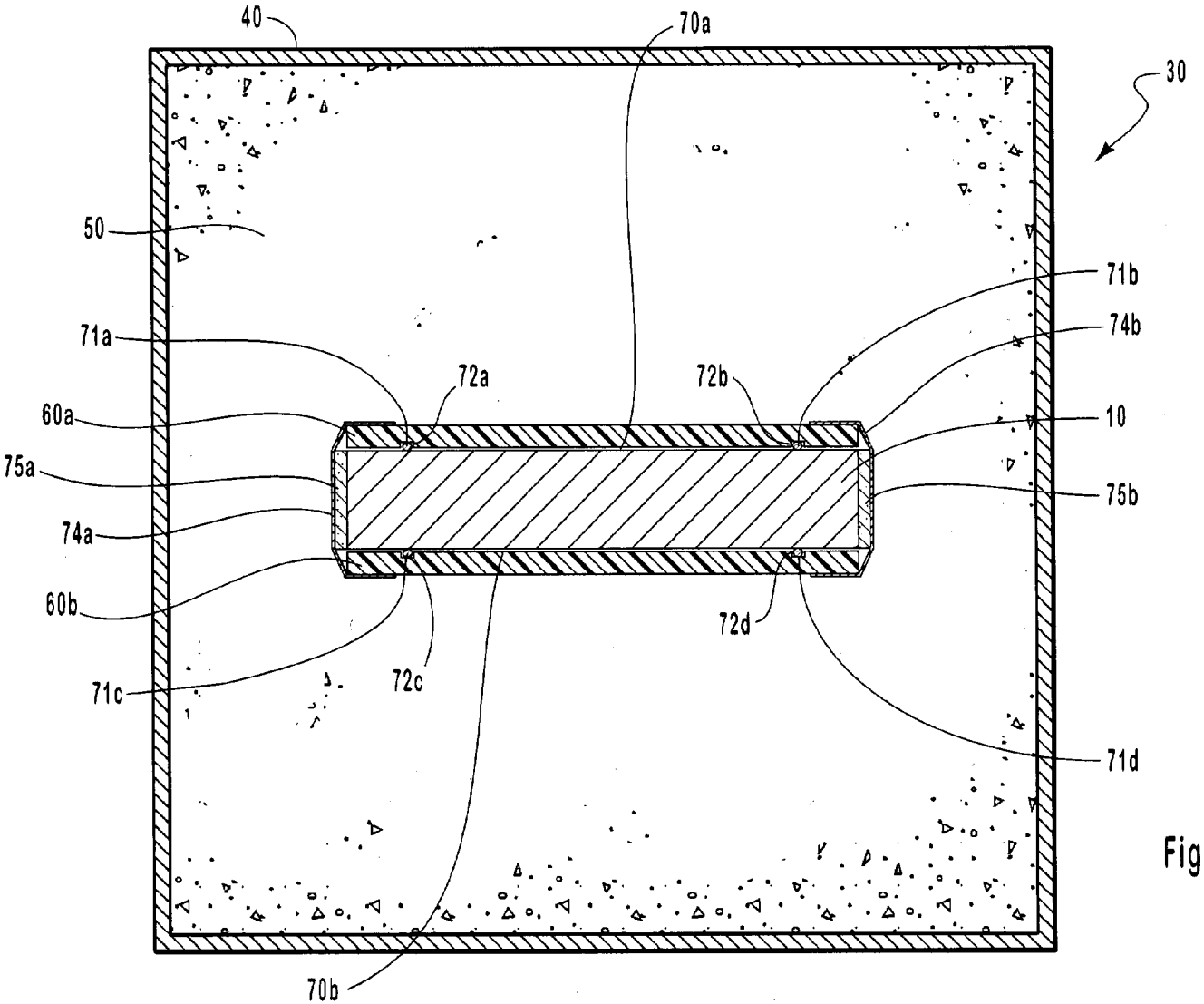
FIG. 3 is a cross-sectional view, taken along cutting plane lines 3-3 of FIG. 1, illustrating the juxtaposition of the core member and the buckling restraining assembly according to one embodiment of the present invention.

FIG. 3 is a cross sectional view illustrating the juxtaposition of the core member 10 and the buckling restraining assembly 30 according to one embodiment of the present invention. In the illustrated embodiment, core member assembly 30 is adapted to surround core member 10 to prevent brace apparatus 1 from buckling when core member 10 undergoes plastic deformation. In the illustrated embodiment, buckling restraining assembly 30 comprises a support tube 40, a cementious layer 50, and bearing members 60*a, b*. Support tube 40 comprises a square metal tube external to the cementious layer 50. Support tube 40 provides strength, flexibility, and a mechanism for enclosing cementious layer 50 and bearing members 60*a, b*. In one embodiment, metal tube 10 surrounds the core member middle portion 10. Support tube 10 is one example of a metal support.

Cementious layer 50 is located internal to support tube 10. Cementious layer 50 provides rigidity to buckling restraining assembly 30. Cementious layer 50 is one example of a rigid layer. In one embodiment, cementious layer 50 has less elasticity than core member 10.

Bearing members 60*a, b* are positioned internal to cementious layer 50. Bearing members 60*a, b* are adapted to limit the amount of friction caused by the movement of part or all of core member 10 relative to part or all of buckling restraining assembly 30. The properties of bearing members 60*a, b* are adapted to provide a desired amount of friction limiting. In one embodiment, bearing members 60*a, b* comprise a first surface, a second surface and a body. The first surface is adapted to be coupled to the cementious or concrete layer. The second surface is adapted to be positioned in close proximity to the core member. The body comprises the bulk of the bearing member. In the preferred embodiment, the body of the bearing member is comprised of ultra high molecular weight (UHMW) polyethylene. In an alternative embodiment, the body is comprised of Teflon. In yet another embodiment, the body is comprised of a material having low compressibility. Similarly, the first and second surfaces can be comprised of UHWM polyethylene, Teflon, or similar materials. In one embodiment, one or more of the bearing members are configured to provide a desired amount of friction limiting. In another embodiment, one or more bearing members are configured to circumscribe core member 10. In yet another embodiment, a plurality of bearing members are included in buckling restraining assembly 30. In yet another embodiment, the plurality of bearing members are internal to, and affixed to, the rigid layer of the buckling restraining assembly.

A variety of configurations of buckling restraining assembly 30 can be utilized within the scope and spirit of the present invention. For example, in one embodiment, buckling restraining assembly 30 comprises a metal support positioned external to the core member. A cementious layer is coupled to the metal support such that the cementious layer surrounds the core member. In one embodiment, the metal support does not surround the cementious layer but is contained in the cementious layer. In another embodiment, the metal tube comprises a metal cylindrical tube circumscribing the cementious layer.

Air gaps 70*a,b* are positioned between core member 10 and buckling restraining assembly 30. In the illustrated embodiment, bearing member 60*a* is positioned adjacent a first side of the core member 10. Bearing member 60*b* is positioned adjacent a second side of the core member 10. Air gap 70*a* is positioned between bearing member 60*a* and the first side of core member 10, while air gap 70*b* is positioned between bearing member 60*b* and the second side of core member 10. Air gaps 70*a,b* are configured to minimize contact between the plurality of bearing members and the core member when there is little or no load on the brace apparatus 1. Air gaps 70*a, b* are also configured such that when the core member is compressed and plastic deformation of the core member occurs, the core member 10 contacts one or both bearing members 70*a, b*.

Air gaps 70*a, b* are also adapted to prevent bonding of the core member 10 to the buckling restraining assembly 30. By preventing bonding of core member 10 and buckling restraining assembly 30, core member 10 can move freely with respect to buckling restraining assembly 30 when core member 10 undergoes plastic deformation. For example, where brace apparatus 1 is adapted to absorb seismic forces, the compression and tension exerted on brace apparatus 1 can compress and elongate core member 10. Air gaps 70*a, b* are adapted to provide a void between core member 10 and the bearing members of the buckling restraining assembly 30 when the brace apparatus 1 is not supporting a load. Due to the fact that core member 10 is not bonded to buckling restraining assembly 30, when forces are exerted on brace apparatus 1, the forces are primarily absorbed by core member 10. In one embodiment, air gaps are configured such that an air gap is positioned between the core member 10 and each of the plurality of bearing members.

The configuration of bearings 60*a, b* results in little or no friction being generated between buckling restraining assembly 30 and core member 10. When seismic, or other, forces are exerted on brace apparatus 1 core member 10 is stretched and compressed. When the forces exceed a given threshold, the forces are absorbed by plastic deformation of core member 10. In one embodiment, compressive deformation of core member 10 results in an expansion or thickening of the core member 10. This causes the core member 10 to contact buckling restraining assembly 30. Bearing members 60*a, b* of buckling restriction assembly limit the amount of friction caused by the compression and elongation of core member 10. Additionally, the configuration of bearing members 60*a, b* permits the brace apparatus 1 to undergo many cycles of compression and tension without significantly deteriorating bearing members 60*a, b*.

During the fabrication of brace apparatus 1 (as will be discussed in more detail below), spacers 71*a-d* are used to create air gaps 70*a, b* between core 10 and bearing members 60*a, b*. Spacers 71*a-d* are adapted to maintain the air gaps 70*a, b* between the portions of the core member corresponding to the plurality of bearing members of the buckling restraining assembly 30. Bearing members 60*a, b* also include elongated slots 72*a-d*, which are formed along the entire length of the interior surface of bearing members 60*a, b* and, which are adapted to receive a portion of each of the spacers 71*a-d*. In one embodiment, elongated slots 72*a-d* are adapted to control the width of air gaps 70*a, b*. For example, in one embodiment the width of air gaps 70*a-d* varies along the length of core member 10. The depth of elongated slots 72*a-d* of bearing members 60*a, b* is configured to provide variation in the width of air gaps 70*a-d*.

Brace apparatus 1 also includes end spacers 75*a, b* and seals 74*a, b*. End spacers 75*a, b* are located at the ends of core member 10. End spacers 75*a, b* are adapted to provide a desired displacement between core member 10 and cementious layer 50. End spacers 75*a, b* can be comprised of foam rubber, insulative materials, or any other materials providing the desired spacing. Seals 74*a, b* are located at and/or around bearing members 60*a, b* and end spacers 75*a, b*. Seals 74*a,*

*b* are adapted to prevent the cementious materials from entering air gaps 70*a, b*. Seals 74*a, b* can comprise tape, silicone, or any other materials adapted to prevent the cementious materials from entering air gaps as is known to one skilled in the art.

Figure 4:
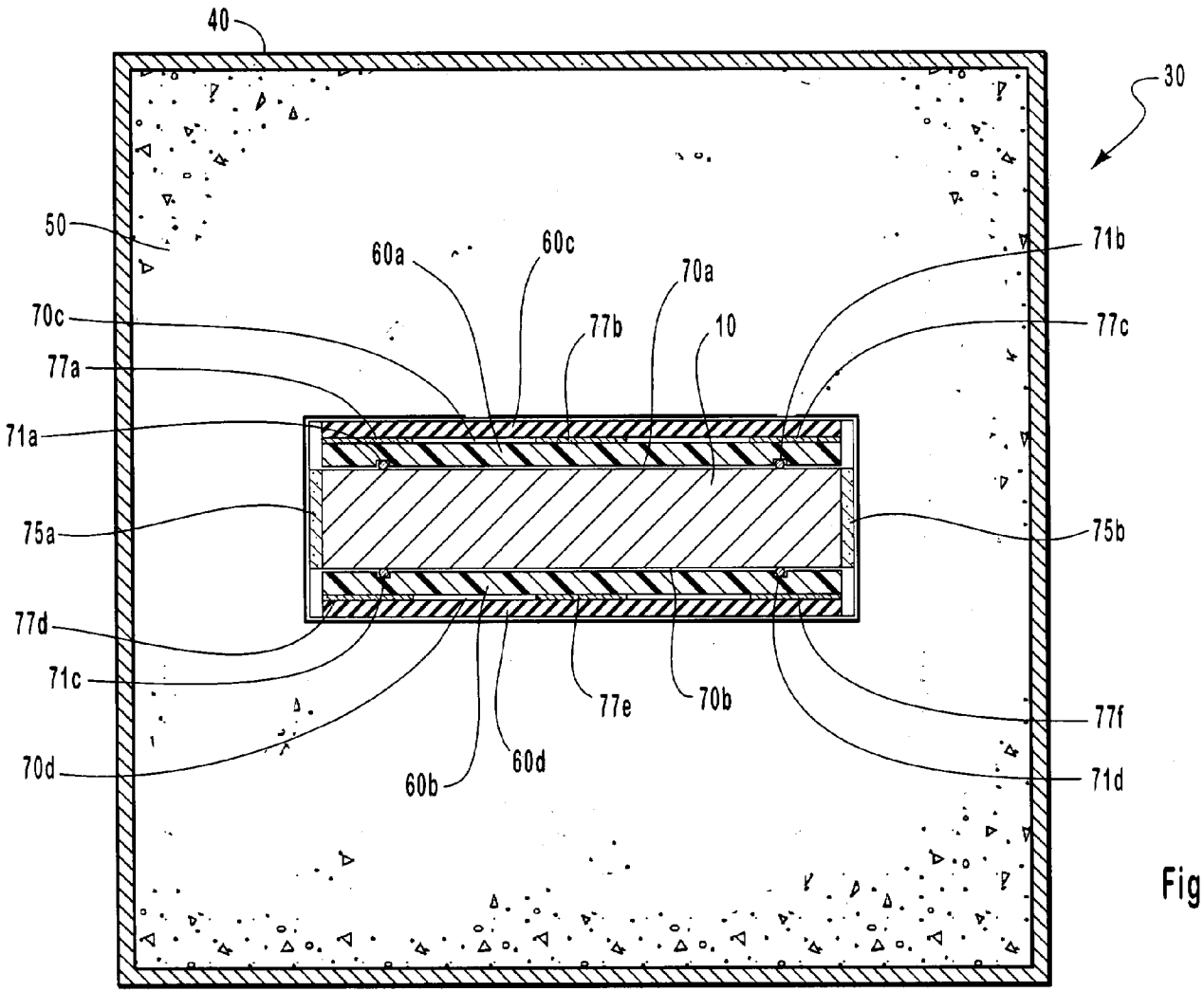
FIG. 4 is a cross-sectional view, taken along cutting plane lines 3-3 of FIG. 1, illustrating the juxtaposition of the core member and the buckling restraining assembly according to an alternative embodiment of the present invention.

FIG. 4 is a cross sectional view illustrating the juxtaposition of the core member 10 and buckling restraining assembly 30 according to an alternative embodiment of the present invention. In the illustrated embodiment, the buckling restraining assembly 30 comprises support tube 40, cementious layer 50, and four bearing members 60*a, b, c, d*. Bearing member 60*a* is positioned adjacent a first side of core member 10. Bearing member 60*b* is positioned adjacent a second side of core member 10. Bearing member 60*c* is positioned between bearing member 60*a* and the cementious layer 50. Bearing member 60*d* is positioned between bearing member 60*b* and the cementious layer 50. In one embodiment, bearing members 60*c, d* are adapted to be coupled to cementious layer 50. As previously discussed, bearing members 60*a-d* are adapted to limit the amount of friction caused by movement of part or all of the core member 10 relative to part or all of the buckling restraining assembly 30.

Air gap 70*a* is positioned between bearing member 60*a* and the first side of core member 10. Air gap 70*b* is positioned between bearing member 60*b* and the second side of core member 10. Yet another air gap 70*c* is positioned between bearing members 60*a* and 60*c*. While yet another air gap 70*d* is positioned between bearing members 60*b* and 60*d*. Spacers 71*a-d* comprise selectively removable rods positioned in elongated slots 72*a-d*. Spacers 71*a-d* are adapted to maintain air gaps 70*a, b* during manufacture of brace apparatus 1. Spacing members 77*a-f* are positioned between bearing members 60*a* and 60*c* and between bearing members 60*b* and 60*d*. Spacing members 77*a-f* are adapted to maintain the spacing between adjacent bearing members 60*a* and 60*c* and 60*b* and 60*d*. In the preferred embodiment, spacing members 77*a-f* are comprised of a compressible material. In one embodiment, spacing members 77*a-f* are comprised of rubberized foam.

Air gaps 70*a-d*, spacers 71*a-d*, and spacing members 77*a-f* are adapted to allow for expansion or an increase in the thickness of core member 10 due to plastic deformation caused by compression of core member 10. In one embodiment, spacing members 77*a-f* are configured such that when little or no load is being held by brace apparatus 1, spacing members 77*a-f* experience little or no compression. By providing spacing members 77*a-f* that undergo little compression under normal circumstances, bearing members 60*a, c* and bearing members 60*b, d* operate as a single bearing member when little or no load is placed on the bearing members 60*a-c*. However, when forces are exerted on brace apparatus 1 such that core member 10 undergoes plastic deformation, spacing members 77*a-f* are compressed, allowing the core member to expand or thicken while limiting the amount of friction generated between core member 10 and bearings 60*a, b*.

Figure 5A:
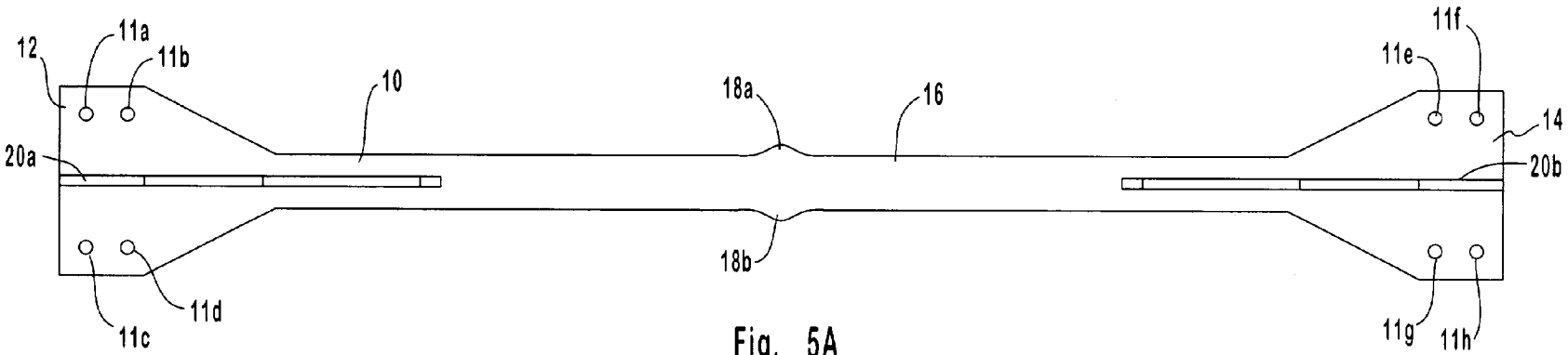
FIG. 5A is a schematic view illustrating the core member and lateral supports according to one embodiment of the present invention.

FIG. 5A is a schematic view illustrating core member 10 according to one embodiment of the present invention. In the illustrated embodiment, core member 10 includes a first end 12, a second end 14, a middle portion 16, and projections 18*a, b*. Projections 18*a, b* are adapted such that cementious layer 50 surrounding the core member 10 contacts projections 18*a, b*. By contacting projections 18*a, b*, core member 10 is prevented from sliding in relation to buckling restraining assembly 30.

In the illustrated embodiment, first and second projections 18*a, b* are contiguous with core member middle portion 16. By allowing projections 18*a, b* to contact cementious layer 50, projection 18*a, b* are adapted to minimize movement of core member middle portion 16 relative to the portion of buckling restraining assembly 30 corresponding to core member middle portion 16. Projections 18*a, b* are also adapted to prevent buckling restraining assembly 30 from sliding in relation core member 10 when little or no load is being supported by support brace 1.

In one embodiment of the present invention, projections 18*a, b* and core member first end, second end, and middle portions 12, 14, 16 are of uniform construction. In an alternative embodiment, projections 18*a, b* are rigidly coupled to one or more portions of core member 10. In the illustrated embodiment, projections 18*a, b* are coupled to the top and bottom of core member middle portion 16. In an alternative embodiment, projections 18*a, b* are coupled to the side of core member middle portion 16. In one embodiment, projections 18*a, b* are bonded to cementious layer 50. In an alternative embodiment, projections 18*a, b* are not bonded to the cementious layer 50.

When a force is exerted on support brace 1 and core member 10 undergoes plastic deformation, the portions of core member 10 having projections are not displaced relative to buckling restraining assembly 30. For example, in the illustrated embodiment, where sufficient compressive and tensile forces are exerted on brace apparatus 1 such that core member 10 is deformed, projections 18*a, b* retain core member middle portion 16 at a consistent position relative to the middle portion of buckling restraining assembly 30. The bonding of projections 18*a, b* and cementious layer 50 prevents lateral movement of the core member middle portion 16 relative to the portion of buckling restraining assembly 30 corresponding to core member middle portion 16. This allows core member 20 to be compressed and elongated such that the displacement between the core member first and second ends 12, 14 and the core member middle portion 16 increases and decreases, while maintaining the relative position of the core member middle portion 16 to the buckling restraining assembly 30.

Figure 5B:
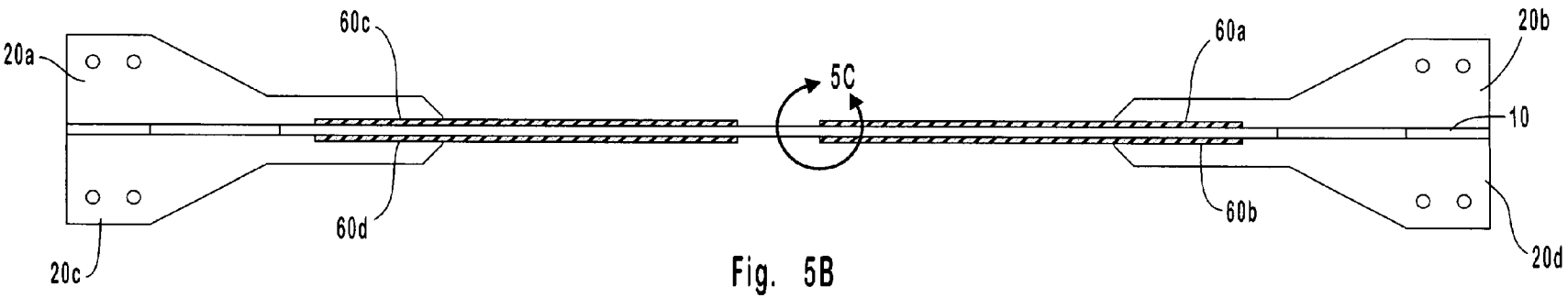
FIG. 5B is a top view illustrating the juxtaposition of the bearing members to the core member and lateral supports according to one embodiment of the present invention.

FIG. 5B is a perspective view illustrating the juxtaposition of the bearing members 60*a-d* to core member 10 of FIG. 5A according to one embodiment of the present invention. In the illustrated embodiment, bearing members 60*a-d* correspond with portions of core member 10 not having projections 18*a, b*. As previously discussed, bearing members 60*a-d* are adapted to limit the amount of friction between bearing members 60*a-d* and core member 10. Bearing members 60*a-d* are positioned internal to and affixed to the cementious layer 50. Bearing members 60*a-d* terminate at core member middle portion 16 to allow cementious layer 50 to contact the projections 18*a,b*.

Figure 5C:
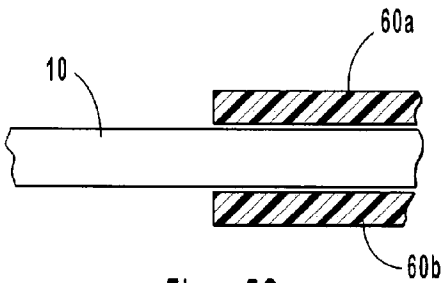
FIG. 5C is a close-up view depicting the air gap between the bearing members and the core member according to one embodiment of the present invention.

FIG. 5C is a close-up view depicting air gaps 70*a, b* located between bearing members 60*a, b* and core member 10 according to one embodiment of the present invention. In the illustrated embodiment, the width of air gaps 70*a, b* is between 1-50 thousandths of an inch. Because expansion of the core member 10 due to compression is typically in the range of less than 1/100th of an inch, air gaps 70*a, b* having a width of less than one-hundredth of an inch are sufficient to accommodate expansion of core member 10 under typical situations. Providing air gaps 70*a, b* having a narrow width allows for expansion of core member 10 while limiting the lateral displacement of core member 10. Because lateral displacement of core member 10 can result in a potential weakening of brace apparatus 1, limiting the width of air gaps 70*a, b* reduces the potential for such weakening.

Figure 6B:
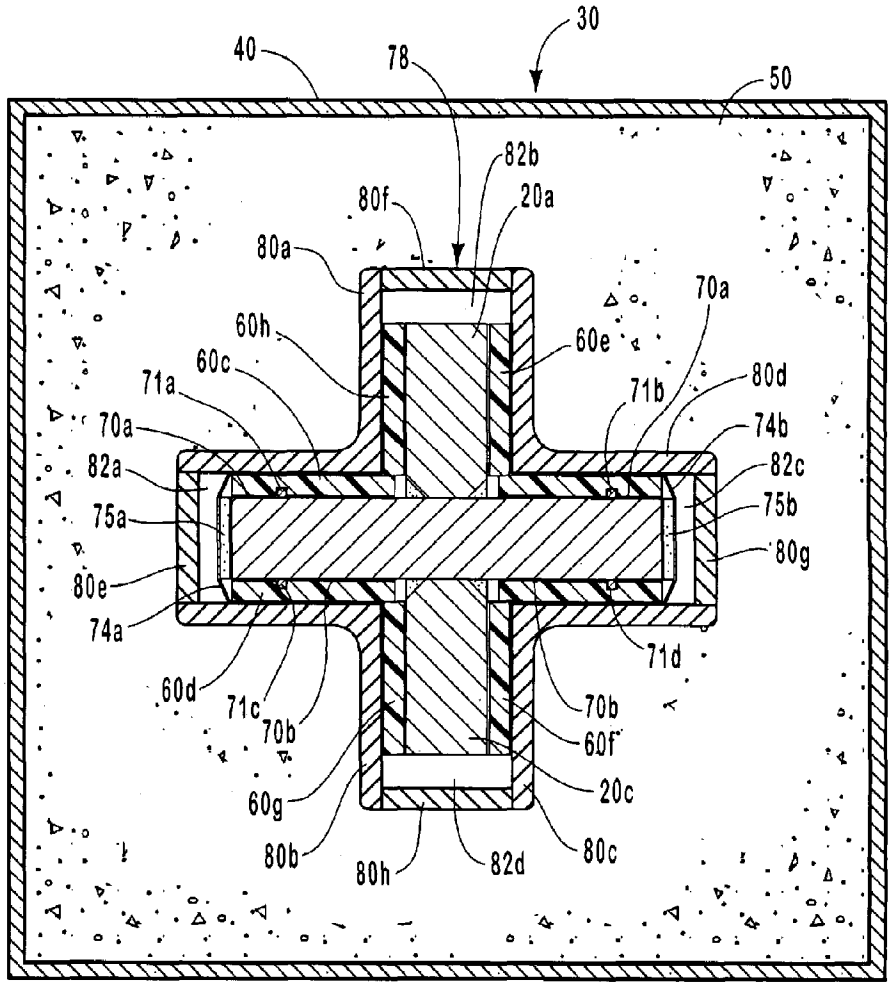
FIG. 6B is an end cross-sectional view illustrating the reinforcement assembly and its juxtaposition to the buckling restraining assembly, core member, and lateral supports according to one embodiment of the present invention.
Figure 6A:
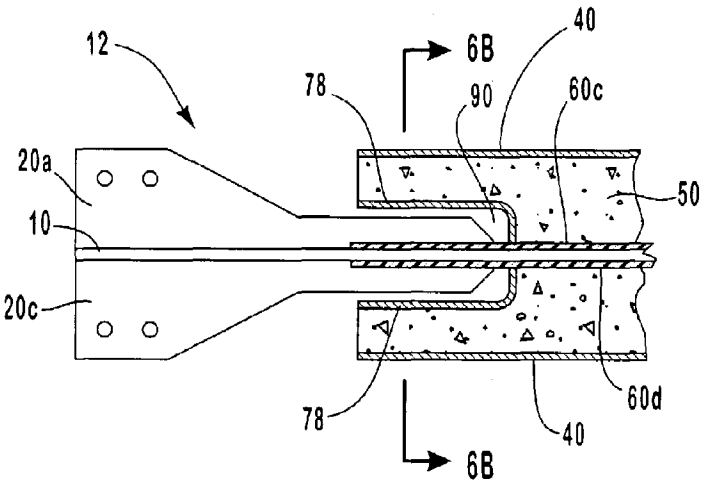
FIG. 6A is a side cross-sectional view illustrating the reinforcement assembly and its juxtaposition to the buckling restraining assembly, core member, and lateral supports according to one embodiment of the present invention.

FIG. 6A is a cross-sectional view illustrating reinforcement assembly 78 and its juxtaposition to the buckling restraining assembly 30, core member 10, and lateral supports 20*a, c* according to one embodiment of the present invention. In the illustrated embodiment, lateral supports 20*a, c* are coupled to core member 10. Lateral supports 20*a, c* are located at, and provide additional support to, the core member first end 12. The portions of lateral support 20*a, c* positioned nearest the core member middle portion 16 are surrounded by the buckling restraining assembly 30. By surrounding portions of lateral supports 20*a, c* with buckling restraining assembly 30, additional support is provided to the core member first end 12, preventing buckling of the core member first end 12. Bearing members 60*c, d* of buckling restraining assembly 30 are adapted to limit friction between the buckling restraining assembly 30 and core member 10. Bearing members 60*e, f* are also positioned adjacent lateral supports 20*a, c*. Bearing members 60*e, f* are adapted to limit friction between the buckling restraining assembly 30 and lateral supports 20*a, c*.

Brace apparatus 1 also includes a reinforcement assembly 78. Reinforcement assembly 78 is adapted to enclose: 1) the portion of lateral supports 20*a, c* corresponding with buckling restraining assembly 30; 2) the portion of the bearing members 60*c-f* corresponding with the portion of lateral supports 20*a, c*; and 3) the portion of the core member 10 corresponding with the portion of lateral supports 20*a,c* and the buckling restraining assembly 30. In additional to providing strength to core member first end 12, reinforcement assembly 78 prevents cementious layer 50 from infiltrating the air gaps between core member 10 and bearing members 60*c-f*. The reinforcement assembly 78 is positioned between the bearing members 60*c-f* and the cementious layer 50 at the portion of buckling restraining assembly 30 corresponding with a portion of lateral supports 20*a, c*.

In the illustrated embodiment, reinforcement assembly 78 extends beyond lateral supports 20*a, c* in the direction of the core member middle portion 16. The portions of reinforcement assembly 78 extending beyond lateral supports 20*a, c* form void 90. Void 90 is adapted to permit end portions of lateral supports 20*a, c* unimpededly to move relative to the buckling restraining assembly 30 in the direction of core member middle portion 16 when core member 10 is compressed.

FIG. 6B is a cross-sectional view (see cross section 6B of FIG. 6A) illustrating reinforcement assembly 78 and its juxtaposition to the buckling restraining assembly 30, core member 10, and lateral supports 20*a, c* according to one embodiment of the present invention. Reinforcement assembly 78 is located internally to, and in contact with, cementious layer 50. Reinforcement assembly 78 is adapted to enclose: 1) the portion of lateral supports 20*a, c* corresponding with buckling restraining assembly 30; 2) a portion of the bearing members 60*e-h*; and 3) the portion of the core member 10 corresponding with the portion of lateral supports 20*a, c* and buckling restraining assembly 30.

In the illustrated embodiment, reinforcement assembly 78 comprises angle members 80*a-d* and end cap members 80*e-h*. The configuration of the angle members 80*a-d* of the present embodiment results in cavities 82*a-d*. In, an alternative embodiment, angle members 80*a-d* are configured such that the end cap members touch the ends of core member 10 and lateral supports 20*a, b*. As will be appreciated by those skilled in the art, reinforcement assembly 78 can have a variety of elements arranged in any of a variety of configurations without departing from the scope or spirit of the present invention. For example, reinforcement assembly can be of a single uniform construction, rather than being comprised of a plurality of members.

In the illustrated embodiment, six bearing members 60*c-h* are enclosed in reinforcement assembly 78. Bearing member 60*c* is positioned adjacent a first side of core member 10. Bearing member 60*d* is positioned adjacent a second side of core member 10. Bearing members 60*e* corresponds with a first side of lateral support 20*a*. Bearing member 60*h* corresponds with a second side of lateral support 20*a*. Bearing member 60*f* corresponds with a first side of lateral support 20*c*. Bearing member 60*g* corresponds with a second side of lateral support 20*c*. Air gaps 70*a* and 70*b* are positioned between bearing members 60*c*, 60*d* and core member 10. Spacers 71*a-d* are provided to maintain the air gap during manufacture of the brace apparatus 1. In the preferred embodiment, the width of air gaps 70*a, b* at the reinforcement assembly is less than the width of air gaps 70*a, b* closer to core member middle portion 16. By providing air gaps 70*a, b* having a more narrow width at the portions of the core member 10 corresponding with the reinforcement assemblies than at the core member middle portion 16, less axial movement of the core member 10 is permitted, reducing the likelihood of core member buckling at these positions.

Figure 7A:
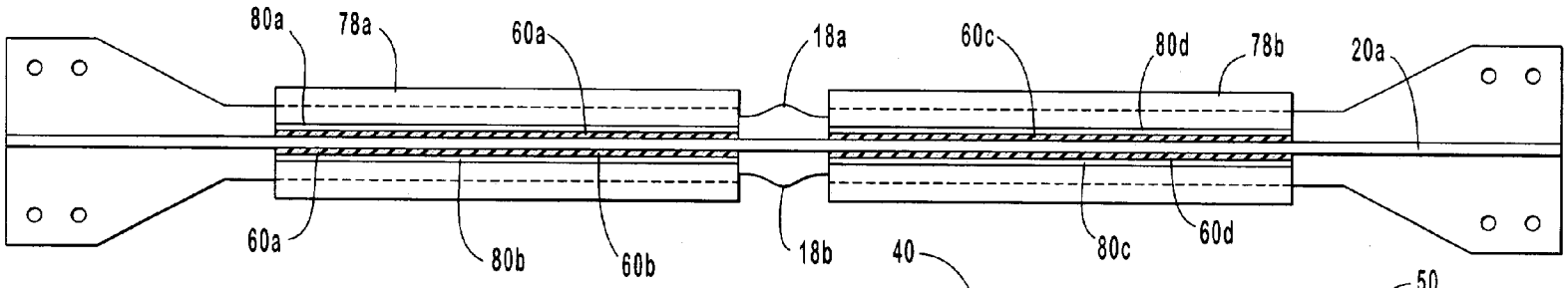
FIG. 7A is a side view illustrating an alternative embodiment of the brace apparatus in which a lateral support extends the length of the core member.

FIG. 7A is a perspective view illustrating an alternative embodiment of the brace apparatus 1 in which lateral support 20*a* extends the length of the core member 10. Lateral support members 20*a, c* are coupled to core member 10 and are adapted to provide additional support to core member 10. Because lateral supports 20*a, b* extend the entire length of core member 10, they provide lateral support for most, or all, of the length of core member 10. Brace apparatus 1 having lateral supports 20*a, b* running the length of the core member can be employed where the size of the brace apparatus 1, or the magnitude of the forces to be absorbed, require additional rigidity for the entire length of the core member 10.

This embodiment also includes first and second reinforcement assemblies 78*a, b*. First and second reinforcement assemblies 78*a, b* are adapted to enclose a plurality of bearing members 60*a-d*, a portion of the lateral support members 20*a, b*, and a portion of core member 10. The reinforcement assemblies 78*a, b* are adapted to be positioned between bearing members 60*a-d* and the cementious layer 50 of the buckling restraining assembly 30. It can be seen that first and second reinforcement assemblies 78*a, b* do not extend for the entire length of lateral supports 20*a, b*. This is due to the fact that the projections 18*a, b* of core member 10 are adapted to be in contact with cementious layer 50. Reinforcement assembly 78*a* corresponds with the plurality of bearing members between the middle portion of brace apparatus 1 and the first end of brace apparatus 1. Reinforcement assembly 78*b* corresponds with the plurality of bearing members between the middle portion of brace apparatus 1 and the second end of brace apparatus 1.

Figure 7B:
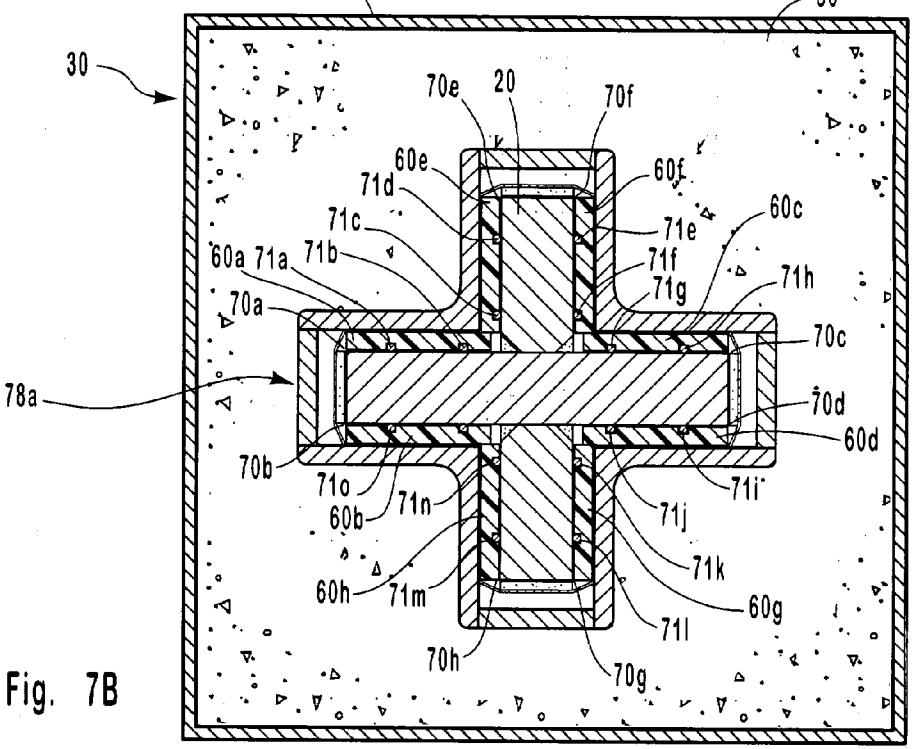
FIG. 7B is a cross-sectional view illustrating the juxtaposition of the core member, lateral supports, buckling restraining assembly and reinforcement assembly according to one embodiment of the present invention.

FIG. 7B is a cross sectional view illustrating the juxtaposition of core member 10, lateral supports 20*a, b*, buckling restraining assembly 30, and reinforcement assembly 78 according to one embodiment of the present invention. In the embodiment, eight bearing members 60*a-h* are utilized for each end of the buckling restriction assembly 30. Four bearing members 60*a-c* are utilized for the cross member 10, two bearing members 60*e, f* are utilized for lateral support 20*a* and two bearing members 60*g, h* are utilized for lateral supports 20*b*. In the illustrated embodiment, air gaps 70*a-h* are positioned between bearing members 60*a-h* and both cross member 10 and lateral supports 20*a, b*. Spacers 71*a-o* are utilized to maintain the air gaps 70*a-h* during manufacture of brace apparatus 1. A greater number of spacers 71*a-o* are utilized in the illustrated embodiment than the embodiment of FIG. 6B due to the increased number and configuration of bearing members 60*a-h*.

One presently preferred method of manufacturing brace apparatus 1 will now be described in relation to the embodiment shown in FIGS. 1-3. First, core member 10 and lateral supports 20*a-d* are fabricated in the forms shown in FIG. 2 according to known methods. Next, lateral supports 20*a, c* are welded to core member first end 12, and lateral supports 20*b, d* are welded to the core member second end 14. Next, spacers 71*a-d* are positioned within elongated slots 72*a-d* of bearing members 60*a, b*, and bearing members 60*a, b* are positioned adjacent opposing sides of the core member middle portion 16, with spacers 71*a-d* being interposed between bearing members 60*a,b* and core 10. End spacers 75*a, b* are then positioned adjacent the remaining two sides of the middle portion 10 of core 10, and seals 74*a, b* are affixed to the outer surfaces of bearing members 60*a, b* and end spacers 75*a, b* as illustrated in FIG. 3. The core member 10 is then inserted through and positioned within steel tube 40 such that core member first and second ends 12 and 14 extend out the opposing ends of steel tube 40. Cement is then introduced into space between the core assembly and steel tube 40 and allowed to harden to form cementious layer 50. Once the cementitious layer 50 has hardened to a predetermined state, spacers 71*a-d* are removed from buckling restraining assembly 30 by withdrawing them from elongated slots 72*a-d*.

A seal is provided to maintain the position of the spacers between the core member 10 and the bearing members 60*a-n*. The seal, bearing members 60*a-n*, core member 10, and spacers 71*a-n* are then inserted into and positioned within to support tube 40. The cementious layer 50 is then positioned between the support tube 40 and the seal, bearing members 60*a-n*, etc.

In one embodiment, cementious material is poured into the support tube in a liquid or semi-liquid state around the seal 74, bearing members 60*a-n*, core member 10, and spacers 71*a-n* to form cementious layer 50. The seal 74 is adapted to prevent the cementious material from entering the one or more air gaps 70. Spacers 71*a-n* are adapted to maintain the one or more air gaps 70 while the cementious layer 50 solidifies. Once the cementious layer 50 is solidified spacers 71*a-n* are removed. In one embodiment spacers 71*a-n* comprise metal rods. In an alternative embodiment spacers 71*a-n* comprise fiberglass or plastic shafts.

Figure 8:
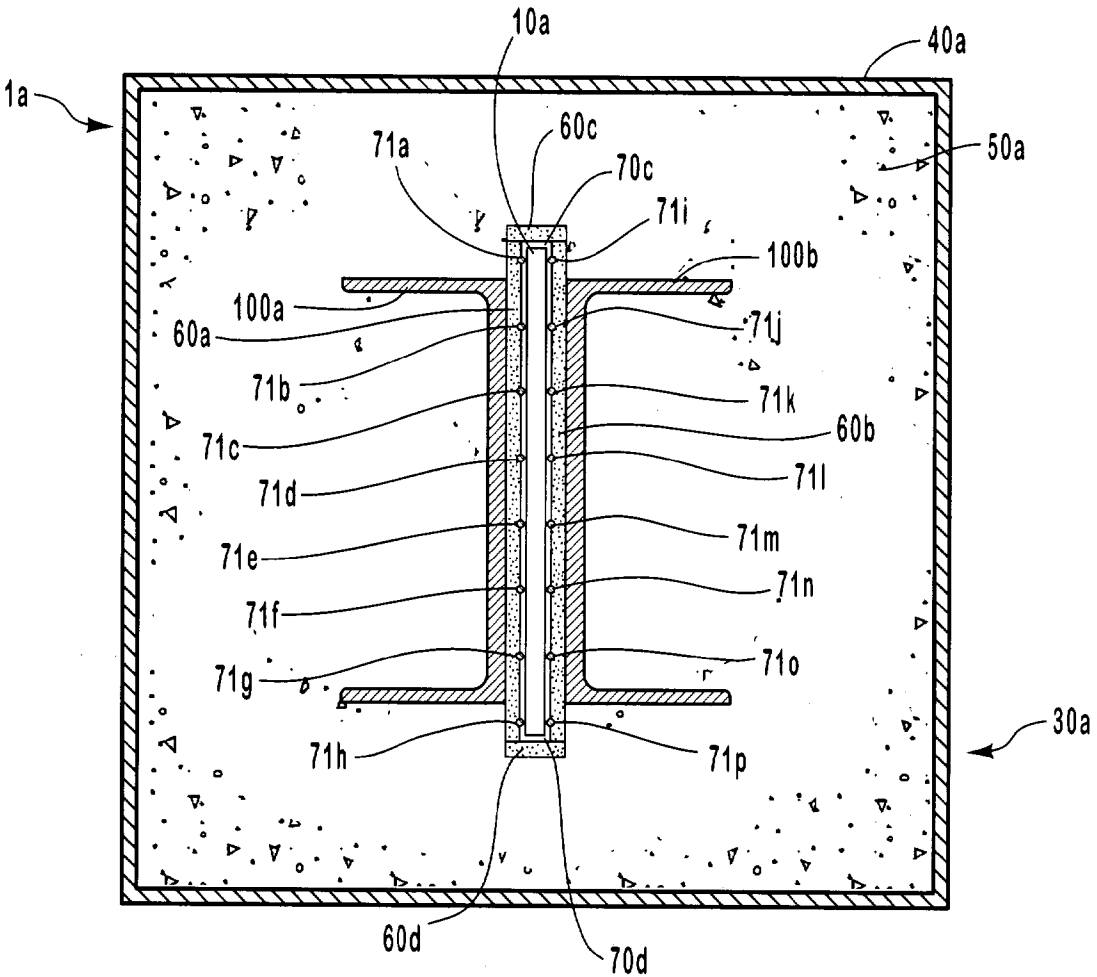
FIG. 8 is a cross-sectional view illustrating the use of support members to maintain the width of the air gaps between the core member and the buckling restraining assembly.

FIG. 8 there illustrates a brace apparatus 1*a* according to one aspect of the present invention. In the illustrated embodiment brace apparatus 1*a* comprises a core member 10*a* and a buckling restraining assembly 30*a*. Core member 10*a* is adapted to absorb seismic or other forces exerted on brace apparatus 1*a*. In the preferred embodiment core member 10*a* is designed to undergo plastic deformation to absorb forces encountered during a seismic or other event having forces of similar magnitude.

Buckling restraining assembly 30*a* is adapted to provide support to core member 10*a*. The additional support provided by buckling restraining assembly 30*a* allows core member 10*a* to absorb large amounts of energy by undergoing plastic deformation while providing the strength necessary to maintain the structural integrity of the brace apparatus 1*a*. In the illustrated embodiment, buckling restraining assembly 30*a* comprises a rigid layer 50*a*, a support tube 40*a*, bearing members 60*a, b, c, d*, and support members 100*a, b*. Support tube 40*a* comprises a metal tube positioned external to rigid layer 50*a*. Support tube 40*a* provides strength and flexibility to buckling restraining assembly. Additionally, support tube 40*a* encloses the other components of buckling restraining assembly 30*a*.

Rigid layer 50*a* is located internal to support tube 40*a*. Rigid layer 50*a* provides rigidity to buckling restraining assembly 30*a* so as to maintain the structural integrity of brace apparatus 1*a* when core member 10*a* is undergoing plastic deformation. A variety of types and configurations of materials can comprise rigid layer 50*a*. In one embodiment, the rigid layer comprises a cementious layer. In an alternative embodiment, the rigid layer is comprised of a foam material. In yet another embodiment the rigid layer is comprised of a polymer material. In an alternative embodiment, the rigid layer is comprised of a material having sufficient shear strength to provide the required rigidity to the buckling restraining assembly.

In the illustrated embodiment buckling restraining assembly 30 includes a plurality of bearing members 60*a, b, c, d*. Bearing members 60*a, b, c, d* are positioned internal to rigid layer 50*a*. Bearing members 60*a, b, c, d* are adapted to limit the amount of friction resulting from movement of part or all of the core member 10*a* relative to part or all of buckling restraining assembly 30*a*. Bearing members 60*a, b* are laterally adjacent the sides of core member 10*a*. Bearing members 60*c, d* comprise cap members contacting bearing members 60*a, b* and are adapted to be positioned adjacent to the top and the bottom of core member 10*a*. As will be appreciated by those skilled in the art, brace apparatus 1*a* can be utilized with or without bearing members 60*a, b, c, d*.

In the illustrated embodiment, brace apparatus 1*a* further comprises air gaps 70*a, b, c, d*. Air gaps 70*a, b, c, d* are positioned between core member 10*a* and buckling restraining assembly 30*a*. Air gaps 70*a, b, c, d* are configured to minimize contact between the plurality of bearing members 60*a, b, c, d* and core member 10*a* when there is little or no load on brace apparatus 1*a*. Additionally air gaps 70*a, b, c, d* limit friction that can be generated between core member 10*a* and buckling restraining assembly 30*a* when core member 10*a* undergoes plastic deformation.

As will be appreciated by those skilled in the art, the amount of deformation experienced during compression and tension cycles is the result of many factors including, but not limited to, the magnitude of forces exerted on brace apparatus 1*a*. Moreover, elastic deformation can occur when the forces exerted on core member 10*a* are insufficient to cause plastic deformation. The width of the air gaps 70*a, b, c, d* minimizes contact between the plurality of bearing members 60*a, b, c, d* and core member 10*a* when there is little or no load on brace apparatus 1*a*. Additionally the width of air gaps 70*a, b, c, d* limits the buckling of core member 10*a* when forces sufficient to cause core member 10*a* to undergo elastic or plastic deformation are exerted on brace apparatus 1*a*.

A variety of widths of air gaps can be utilized without departing from the scope or spirit of the present invention. For example, in one embodiment, the width of the air gaps can range between 1/100ths of an inch and 12/100ths of an inch. In an alternative embodiment, an air gap width of 1/100ths of an inch is provided for each ¼ of an inch thickness of the core member 10. For example, a core member having a thickness of ½ of an inch would be associated with air gaps of 2/100ths of an inch. Alternatively, a core member having a thickness of 1 inch would be associated with an air gap of 4/100ths of an inch. As previously mentioned, a variety of factors affect the desired width of the air gap including but not limited to, the thickness of the core member, the length of the core member, the material properties of the core member, and the like.

As will be appreciated by those skilled in the art, air gaps and bearing members can be used in combination or singly to minimize the friction between core member 10 and buckling restraining assembly 30. For example, in one embodiment, brace apparatus 1 includes air gaps but not bearing members. In alternative embodiment, brace apparatus 1 includes bearing members but not air gaps. In yet another embodiment, bearing apparatus includes both air gaps and bearing members.

In the illustrated embodiment, spacers 71*a-p* and support members 100*a, b* are illustrated. Spacers 71*a-p* and support members 100*a, b* are used to create and maintain the desired widths of air gaps 70*a, b* between core member 10*a* and bearing members 60*a, b* during fabrication of brace apparatus 1*a*. Spacers 71*a-p* are adapted to ensure a minimum width of air gaps. Support members 100*a, b* are adapted to maintain a maximum width of air gaps 70*a, b* by preventing bearing members from moving away from core member during fabrication of brace apparatus 1*a*.

In the illustrated embodiment spacers 71*a-p* are positioned in close proximity to one another to prevent bowing of bearing members 60*a, b* from forces exerted on the bearing members during fabrication of brace apparatus 1*a*. As will be appreciated by those skilled in the art, the distance between spacers can depend on a variety of factors including the material properties of the bearing members, the width of the air gaps, and the type of spacers utilized. For example, in one embodiment the spacers are positioned approximately one and a half inches apart to provide the require support for the bearing members.

A variety of types and configurations of spacers can be utilized without departing from the scope or spirit of the present invention. For example, in the illustrated embodiment spacers 71*a-p* comprise wires configured to maintain the desired width of the air gap. In an alternative embodiment, the spacers comprise a plurality of straps. In yet another alternative embodiment, the spacers comprise gauge material such as plastic or metal sheets to maintain the width of the air gap. As previously discussed, once the rigid layer is sufficiently hardened or otherwise formed or positioned as part of the buckling restraining assembly the one or more spacers can be removed without affecting the width of air gaps.

Support members 100*a, b* are positioned between bearing members 60*a, b* and rigid layer 50. In one embodiment, support members 100*a, b* are connected by an adhesive strip, metal strap, or other mechanism to exert a force on bearing members 60*a, b* so as to maintain the position of the bearing members, spacers, and core member relative to one another. Support members 100*a, b* maintain a desired maximum width of the air gap by preventing bearing members 60*a, b* from moving away from core member 10*a* during fabrication of brace apparatus 1*a*.

Figure 9:
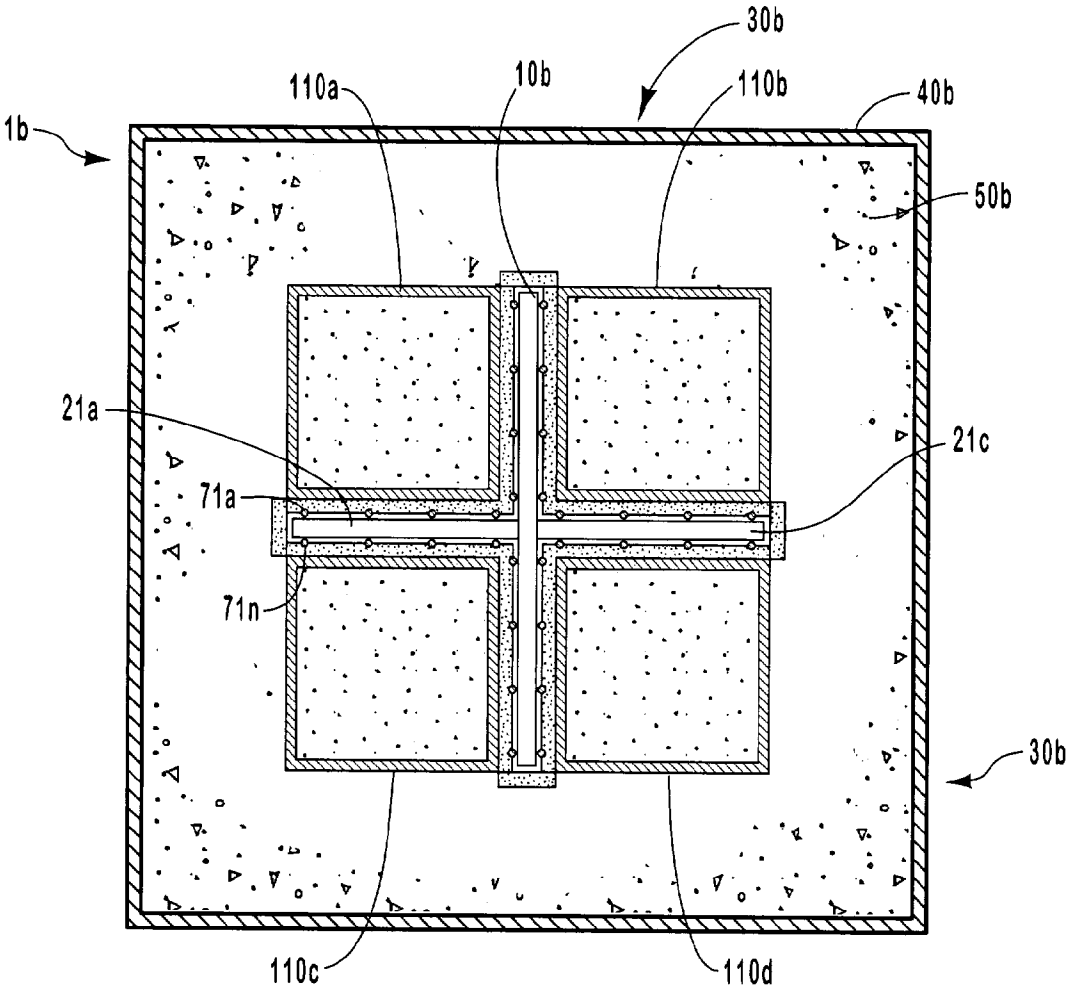
FIG. 9 is a cross-sectional view illustrating alternative support members for maintaining the width of air gaps between the buckling restraining assembly and both the core member and the lateral supports.

FIG. 9 depicts a cross sectional view of a brace apparatus 1*b* according to one aspect of the present invention. A core member 10*b* and lateral supports 21*a, c* are included in brace apparatus 1*b*. In the illustrated embodiment, a plurality of support members 110*a, b, c, d* are utilized. Support members 110*a, b, c, d* comprise rectangular tubes positioned adjacent core member 10*b* and lateral supports 21*a, c*. Support members 110*a, b, c, d* are filled with the material comprising rigid layer 50*b*. Support members 110*a, b, c, d* maintain the position of the bearing members, the core member, and the spacers relative to one another to maintain the appropriate width of the air gaps. A variety of types and configurations of support members can be utilized without departing from the scope and spirit of the present invention. For example, in one embodiment, the lateral supports and support members comprising rectangular tubes extend substantially the entire length of the core member middle portion. In another embodiment, the lateral supports and support members comprising rectangular tubes extend a portion of the length of each end of the core member.

In one embodiment of the present invention, core member 10*b*, lateral supports 21*a, c*, and/or the portion of the buckling restraining assembly adjacent the air gaps are lubricated so as to minimize friction arising from contact between core member 10*b* and/or lateral supports 21*a, c*, and the buckling restraining assembly 30*b*. In the embodiment, core member 10*b* and/or lateral supports 21*a, c* are lubricated with a thin layer of lubricant material to minimize friction resulting from contact between core member 10*b* and/or lateral supports 21*a, c* and buckling restraining assembly 30*b*.

The lubricant material can also minimize degradation and/or corrosion of the core member 10*b* and/or lateral supports 21*a, c*. The lubricant material can minimize degradation by preventing interaction with environmental factors that can react with and corrode the materials from which core member 10*b* and/or lateral supports 21*a, c* are constructed. A variety of types and configurations of lubricants can be utilized without departing from the scope and spirit of the present invention. For example, in one embodiment, a petroleum based lubricant such as axel grease or petroleum jelly can be utilized. In an alternative embodiment, a lubricating powder such as graphite can be utilized. In yet another embodiment, a lubricant is utilized that reduces friction between the core member and the buckling restraining assembly is utilized.

Figure 10:
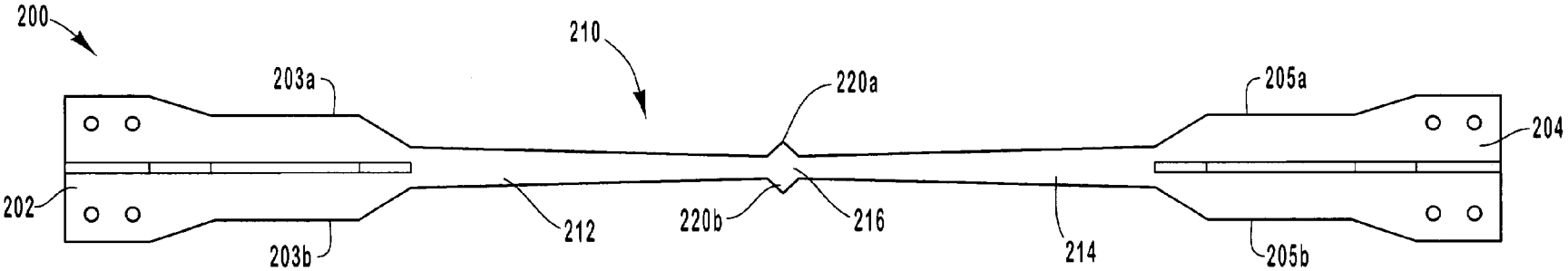
FIG. 10 is a side view of a core member having a core member middle portion of variable width.

FIG. 10, illustrates a core member 200 according to one aspect of the present invention. In the illustrate embodiment, core member 200 comprises a core member first end 202, a core member second end 204, and a core member middle portion 210. In the illustrated embodiment, core member first end 202 and core member second end 204 secure the brace apparatus to the structural frame of a building. Core member middle portion 210 undergoes plastic deformation to absorb energy from seismic magnitude forces to prevent damage to the frame structure of the building.

Core member first end 202 includes secondary transitions 203*a, b*. Core member second end 204 includes secondary transitions 205*a, b*. Secondary transitions 203*a, b* and 205*a, b* are positioned inside the buckling restraining assembly during construction of the brace apparatus. Secondary transitions provide lateral support to minimize lateral deformation of core member 210 at middle portion first and second ends. The secondary transitions 203*a, b* isolates core member 210 to minimize the twisting movement that is produced by loading on the brace apparatus.

In the illustrated embodiment, core member middle portion 210 comprises a middle portion first end 212, a middle portion second end 214, and a middle portion center 216. There is also shown projections 220*a, b* that correspond with middle portion center 216. In the illustrated embodiment, core member middle portion 210 has a variable width. Middle portion center 216 is more narrow than middle portion first end 212 and middle portion second end 214. The core member middle portion is the most narrow at the middle portion center 216 and progressively widens toward the middle portion first end and the middle portion second end. The variability in width of the core member middle portion can vary without departing from the scope and spirit of the present invention. For example, in one embodiment the variability in width between the middle portion center 216 and the middle portion first and second ends 212, 216 is between one percent to sixty percent. In another embodiment, the variability in width between the middle portion center 216 and the middle portion first and second ends 212, 216 is between five percent to twenty five percent. In one embodiment, the variability in width is uniform. In an alternative embodiment, the variability in width changes from one portion to another portion rather than being of uniform nature. The variable width of core member middle portion 210 controls deformation of core member middle portion 210 such that middle portion center 216 undergoes plastic deformation before middle portion first and second ends 214, 216.

The amount of force required to cause core member middle portion 210 to undergo plastic deformation is a product of the cross-sectional area of the core member middle portion. By utilizing a core member middle portion having a variable width, plastic deformation occurs first at the portion of the core member middle portion 210 having the smallest cross sectional area. Because middle portion center 216 has the smallest cross sectional area, middle portion center 216 undergoes plastic deformation before portions of core member middle portion 210 having larger cross sectional areas. Because middle portion first end 212 and middle portion second end 214 have larger cross sectional areas than the other portions of core member middle portion 210, middle portion first end 212 and middle portion second end 214 are the last parts of the core member middle portion 210 to undergo plastic deformation.

The variable width of core member middle portion 210 also controls the amount of deformation of portions of the core member middle portion. The amount of force required to create a given amount of deformation is also the result of the cross-sectional area of the core member middle portion. Thus as the portions of the core member middle portion undergo plastic deformation, the greatest amount of deformation will be occurring at the portion of the core member middle portion having the smallest cross-sectional area.

As core member middle portion 210 undergoes plastic deformation, one or more sections of core member middle portion 210 bind to buckling restraining assembly 30. When a segment of core member middle portion 210 binds with buckling restraining assembly 30, the effective length of core member middle portion 210 undergoing plastic deformation is shortened. While the effective length of core member middle portion 210 undergoing plastic deformation is shortened, the amount of energy to be absorbed is unchanged. As a result, a greater amount of the energy must be absorbed per unit length of core member 200. This results in greater stress on core member middle portion 210 and can lead to premature failure of the brace apparatus.

Binding with buckling restraining assembly occurs when a portion of core member middle portion 210 undergoes sufficient deformation to bind with the buckling restraining assembly. The controlled deformation resulting from the variable width of core member middle portion 210 prevents premature restriction of the effective length of the portion of the core member middle portion 210 undergoing plastic deformation. This is because the portion of core member middle portion to undergo the amount of deformation required to bind with the buckling restraining assembly will be the portion of the core member middle portion having the smallest cross sectional area. Due to the variable width of the core member middle portion, shortening of the core member middle portion occurs gradually from the core member middle portion to the middle portion first and second ends. As a result, binding of middle portion first and second ends is prevented until the middle portion center has bonded with the buckling restraining assembly. By preventing premature restriction of the effective length of the portion of the core member undergoing plastic deformation, premature failure of the brace apparatus is avoided.

As will be appreciated by those skilled in the art, the core member can have a variety and types of configurations without departing from the scope and spirit of the present invention. For example, in one embodiment the core member has a variable thickness to control deformation of the core member. In an alternative embodiment, the core member has a variable cross sectional area as a result of one or more characteristics of the core member to control deformation of the core member middle portion. In an alternative embodiment, the deformation of the core member middle portion is controlled by varying the material properties of the core member middle portion.

Figure 11:
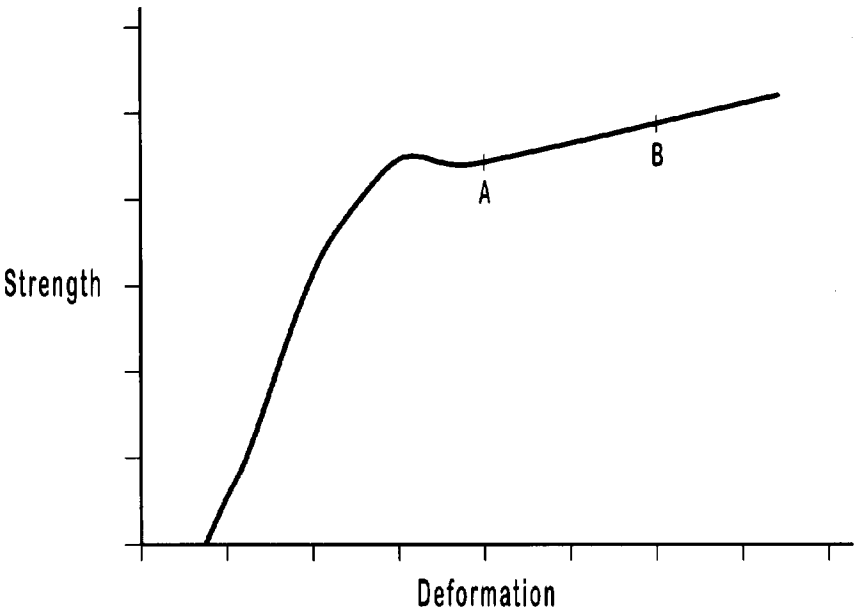
FIG. 11 is a line graph illustrating the relationship between the strength of the core member and deformation of the core member.

FIG. 11 depicts a strength deformation curve illustrating the relationship between the strength of the core member middle portion and plastic deformation of the core member middle portion. In the illustrated embodiment, when the core member middle portion undergoes plastic deformation the metallurgic properties of the core member result in an increase in the strength of the portion of the core member undergoing plastic deformation. The strength deformation curve illustrated in FIG. 11 indicates that the strength of the core member middle portion increases sharply with small amounts of deformation at the beginning of the curve. A peak in the strength deformation curve corresponds to a point at which the deformation becomes more sizeable while resulting in smaller increases in the strength of the core member. It will be understood that the strength deformation curve is included for illustrative purposes and is not intended to depict actual values or relationships beyond what is discussed for illustrative purposes.

When the slope of the strength deformation curve is steep, the core member undergoes very little deformation while the strength of the middle portion is increasing substantially. Due to the relatively small deformation at this point in the curve, the likelihood that the core member will bind within the buckling restraining assembly is limited. When the slope of the strength deformation curve is less steep (i.e. after the peak in the curve), the core member undergoes larger amounts of deformation with respect to small increases in the strength of the brace. Due to the larger amounts of deformation of the core member middle portion, binding of the core member middle portion to the buckling restraining assembly is more likely. This indicates that the core member is able to absorb large amounts of energy with a minimal plastic deformation before reaching the peak in the strength deformation curve. After the peak is reached, the amount of deformation increases substantially for small amounts of increase in energy. The large changes in deformation after the peak quickly will tend to result in buckling and/or failure of the core member after a limited number of compression and elongation cycles.

As discussed with reference to FIG. 10, the variable width of core member middle portion 210 results in controlled deformation of core member middle portion 210. The portion of the core member middle portion which first binds with the buckling restraining assembly will be the portion of the core member middle portion which is first to undergo the amount of deformation required to bind with the buckling restraining assembly. Deformation of the core member middle portion varies in inverse proportion to the cross-sectional area of the core member middle portion. Because the portion of the core member middle portion that has the smallest cross-sectional area is the middle portion center, the deformation of the core member middle portion will be the greatest at the middle portion center. As a result, binding of the core member middle portion first occurs at the middle portion center. A discrete point on the strength deformation curve indicated by the letter "A" corresponds with the stage at which middle portion center 216 may bond with buckling restraining assembly 30. The bonding of the middle portion center 216 results in little change in the effective length of the core member middle portion undergoing plastic deformation. The point on the strength deformation curve corresponding with the letter "B" represents a point at which another segment of the core member middle portion closer to middle portion first or second end may bind with the buckling restraining assembly. As one or more segments of the core member middle portion closer to middle portion first or second end 212, 214 bind with buckling restraining assembly 30 the effective length of the core member undergoing plastic deformation is more substantially shortened and the core member is more likely to fail. By providing a core member middle portion having a variable width, binding of the core member to the buckling restraining assembly is controlled such that the effective length of the core member middle undergoing plastic deformation is gradually shortened. This prevents random and premature bonding of the middle portion first or second ends to the buckling restraining assembly and the subsequent premature failure of the brace apparatus 1.

In embodiments of the brace apparatus in which projections corresponding with middle portion center are bonded with the buckling restraining assembly 30 during manufacture of brace apparatus 1, deformation of the core member middle portion results in little change in the effective length of the core member middle portion undergoing plastic deformation. As a result, the portion of the core member middle portion to first bind with the buckling restraining assembly will be the portion of the core member adjacent the middle portion center. Nevertheless, the benefits of utilizing a core member having a variable width are the same as for braces not utilizing projections. Binding of the core member to the buckling restraining assembly is controlled such that the effective length of the core member middle portion absorbing seismic energy is gradually shortened, preventing random and premature bonding of the middle portion first or second ends to the buckling restraining assembly and the subsequent premature failure of the brace apparatus.

Figure 12A:
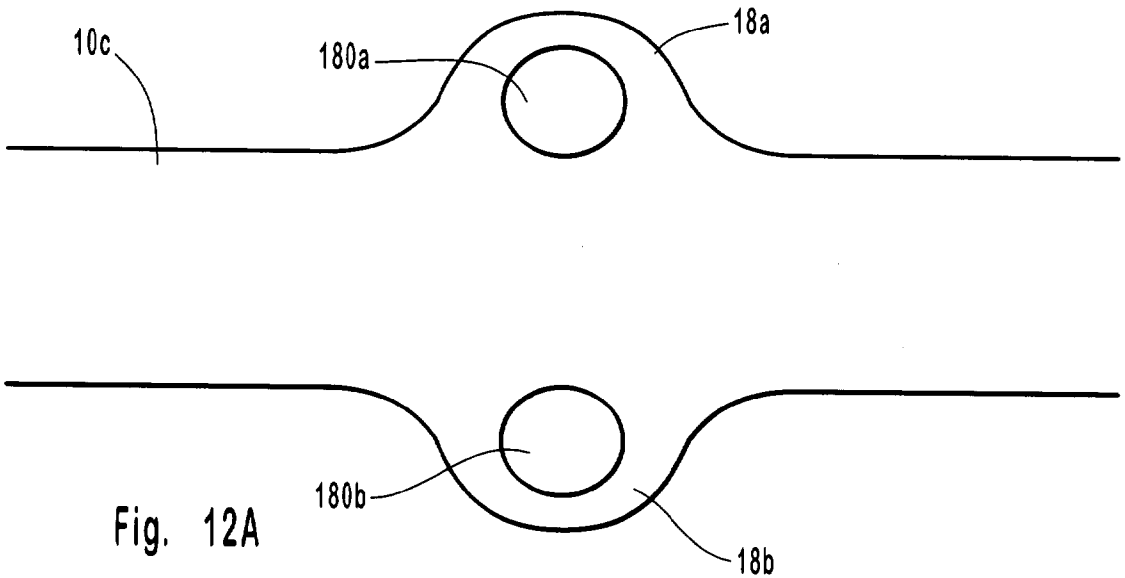
FIGS. 12A, B illustrate projections coupled to the core member having stress reduction voids.

FIG. 12*a* illustrates core member 10*c* having projections 18*a, b*. In the illustrated embodiment projections 18*a, b* include stress reduction voids 180*a, b*. Projections 18*a, b* are adapted to be contacted by rigid layer 50. By being contacted by rigid layer 50 projections 18*a, b* prevent core member 10*c* from sliding in relation to buckling restraining assembly 30. When core member 10*c* is subjected to seismic magnitude forces, the energy is absorbed by plastic deformation of core member 10*c*. The absorption of energy by the core member is a product of the cross sectional area of the core member.

Stress risers can arise where the cross sectional area of the core member middle portion changes abruptly from one region to another. Stress risers can lead to premature failure of the core member. The use of stress reduction voids 180*a, b* effectively limits the cross sectional area of the portion of the core member corresponding with projections 18*a, b* to the cross sectional area of the core member middle portion center. This eliminates stress risers that would otherwise be present at the portion of the core member corresponding with projections 18*a, b*. This substantially reduces the probability of premature failure of the core member.

It can also be seen that projections 18*a, b* have a smooth radius. The smooth radius of projections 18*a, b* streamlines the strain flow created by the absorption of seismic magnitude forces. The streamlining of strain flow also assists in the elimination of stress risers in the portions of core member middle portion corresponding to projections 18*a, b*.

Figure 12B:
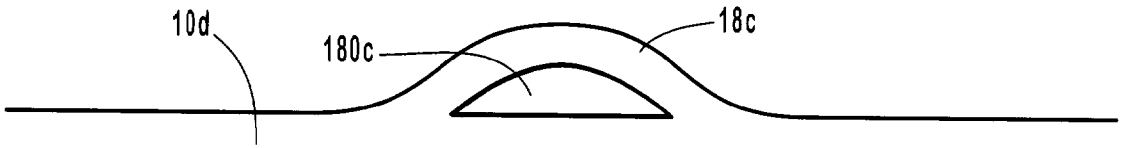

FIG. 12B illustrates a projection 18*c* having a stress reduction void 180*c*. In the illustrated embodiment stress reduction void 180*c* is configured to closely approximate the outline of projection 18*c* and core member 10*d* so as to maintain a more uniform cross-sectional area of the portion of core member corresponding to projection 18*c*. It will be appreciated that a variety of types and configurations of projections with stress reduction voids can be utilized without departing from the scope and spirit of the present invention. In the illustrated embodiment, projection 18*c* is configured to be contacted by the material forming rigid layer 50. Stress reduction void 180*c* assists in the binding of projection 18*c* to the rigid layer 50, thus assisting in minimizing movement of the core member relative to the buckling restraining assembly 30.

Figure 13:
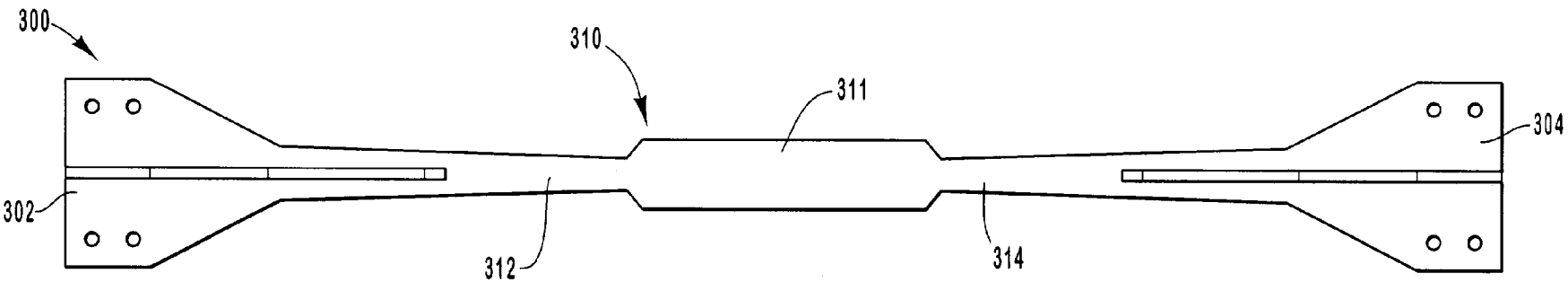
FIG. 13 shows a core member having a core stiffener coupled to the core member middle portion.

FIG. 13 illustrates a core member 300 according to one aspect of the present invention. In the illustrated embodiment core member 300 comprises a core member first end 302, a core member second end 304, and a core member middle portion 310. In the illustrated embodiment, the core member middle portion 310 includes a core stiffener 311. Core stiffener 311 is adapted to provide additional rigidity to core member 300 so as to limit movement of the core member during elastic deformation.

A first deformable region 312 is positioned between core member first end 302 and core stiffener 311 while a second deformable region 314 is positioned between core member second end 304 and core stiffener 311. First deformable region 312 and second deformable region 314 are configured to undergo plastic deformation to absorb seismic magnitude forces exerted on the core member 300.

Core stiffener 311 allows core member 300 to have a longer length relative to its width while continuing to provide the rigidity required for adequate structural support. This allows core member 300 and brace apparatus 1 to have a longer and less massive configuration. Core stiffener 311 is configured to be contacted directly by the rigid layer of the buckling restraining assembly. As a result, the effective deformable length of the core member is provided by first deformable region 312 and second deformable region 314. First deformable region 312 and second deformable region 314 provide an effective deformable length comparable with shorter brace apparatuses. Additionally, by placing core stiffener 311 at the center of core member middle portion 310, movement of core member first end 302 and core member second end 304 relative to the buckling restraining assembly (resulting from plastic deformation of the first and second deformable regions 312, 314) occurs naturally and without obstruction.

As will be appreciated by those skilled in the art, a variety of different types and configurations of brace apparatuses can be utilized without departing from the scope and spirit of the present invention. In one embodiment the buckling restraining assembly comprises a rigid support structure and a bearing member but does not include a cementious layer. For example, the rigid support structure can have an all-metal configuration. In another embodiment, a bearing member having a variable width corresponding with the variable width of the core member middle portion is utilized. In the illustrated embodiment, the core member middle portion has a variable width. As will be appreciated by those skilled in the art the core stiffener can be utilized with a core member having a uniform width or a variable cross-sectional area due to other factors.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A brace apparatus comprising: a core member having a first end, a second end, and a middle portion, wherein the core member middle portion includes one or more projections; the core member middle portion having a varying cross-sectional area and progressively widening from the core member middle portion to the core member first end, at which point the core member middle portion terminates, and from the core member middle portion to the core member second end, at which point the core member middle portion terminates; and a buckling restraining assembly circumscribing the middle portion of the core member, the buckling restraining assembly comprising; a metal support positioned external to the middle portion of the core member; and a rigid layer coupled to the metal support, wherein the rigid layer contacts one or more projections of the core member, further comprising an air gap positioned between the core member and at least a portion of the rigid layer to prevent bonding of the buckling restraining assembly to one or more portions of the core member.

2. A brace apparatus comprising: a core member having a core member first end, a core member second end, a core member middle portion, the core member middle portion having a varying cross-sectional area and progressively widening from the core member middle portion to the core member first end, at which point the core member middle portion terminates, and from the core member middle portion to the core member second end, at which point the core member middle portion terminates; a buckling restraining assembly circumscribing the middle portion of the core member, the buckling restraining assembly comprising; a metal support positioned external to the middle portion of the core member; and a rigid layer coupled to the metal support and circumscribing the core member and further comprising an air gap positioned between the core member and the buckling restraining assembly to prevent bonding of the buckling restraining assembly to one or more portions of the core member.

3. The brace apparatus of claim 2, wherein the core member middle portion comprises a middle portion first end, a middle portion second end, and a middle portion center.

4. The brace apparatus of claim 2, wherein the middle portion center undergoes plastic deformation before portions of the core member middle portion having larger cross sectional areas.

5. The brace apparatus of claim 2, wherein the variable cross-sectional area of the core member middle portion controls deformation of the core member middle portion such that the middle portion center undergoes plastic deformation before the middle portion first and second ends.

6. The brace apparatus of claim 5, wherein controlled deformation resulting from the varying width of the core member middle portion prevents premature restriction of the effective length of the core member middle portion undergoing plastic deformation.

7. The brace apparatus of claim 5, wherein binding of the core member to the buckling restraining assembly is controlled such that the effective length of the core member middle portion absorbing seismic energy is gradually shortened, preventing random and premature bonding of the middle portion first or second ends to the buckling restraining assembly and the subsequent premature failure of the brace apparatus.

8. The brace apparatus of claim 2 wherein the projection contacts the rigid layer.

9. The brace apparatus of claim 8 wherein the contact between the projection and the rigid layer prevents the core member from sliding in relation to the buckling restraining assembly.

10. The brace apparatus of claim 2 wherein the rigid layer is a cementitious layer.

11. The brace apparatus of claim 2 wherein the projection comprises a stiffener.

12. The brace apparatus of claim 2 wherein the projection has a stress reduction void.

13. The brace apparatus of claim 2 wherein the core member middle portion widens from about 1% to about 60%.

14. The brace apparatus of claim 2 wherein the core member middle portion widens from about 5% to about 25%.

15. The brace apparatus of claim 2 wherein the first end comprises a secondary transition.

16. The brace apparatus of claim 2 wherein the second end comprises a secondary transition.

* * * * *